US007048964B2

(12) United States Patent
McGlinchy et al.

(10) Patent No.: US 7,048,964 B2
(45) Date of Patent: May 23, 2006

(54) CONTROLLED DISPENSING OF MATERIAL

(75) Inventors: Timothy Bryan McGlinchy, Twinsburg, OH (US); William A. Briese, Hinckley, OH (US)

(73) Assignee: GED Integrated Solutions, Inc., Twinsburg, OH (US)

( * ) Notice: Subject to any disclaimer, the term of this patent is extended or adjusted under 35 U.S.C. 154(b) by 0 days.

(21) Appl. No.: 10/430,662

(22) Filed: May 6, 2003

(65) Prior Publication Data

US 2003/0205315 A1 Nov. 6, 2003

Related U.S. Application Data

(63) Continuation-in-part of application No. 09/733,272, filed on Dec. 8, 2000, now Pat. No. 6,630,028.

(51) Int. Cl.
*B05D 1/26* (2006.01)

(52) U.S. Cl. ..... 427/208.6; 427/284; 427/286

(58) Field of Classification Search ..... 427/208.6, 427/284, 286, 287
See application file for complete search history.

(56) References Cited

U.S. PATENT DOCUMENTS

| | | | | |
|---|---|---|---|---|
| 3,280,523 | A | 10/1966 | Stroud et al. | |
| 4,088,522 | A | 5/1978 | Mercier | |
| 4,145,237 | A | 3/1979 | Mercier et al. | |
| 4,530,195 | A | 7/1985 | Leopold | |
| 4,546,723 | A | 10/1985 | Leopold et al. | |
| 4,564,410 | A * | 1/1986 | Clitheros et al. | 156/356 |
| 4,787,332 | A | 11/1988 | Geisel et al. | |
| 4,964,362 | A * | 10/1990 | Dominguez | 118/315 |
| 5,044,309 | A | 9/1991 | Crumbach et al. | |
| 5,105,591 | A | 4/1992 | Leopold | |
| 5,136,974 | A | 8/1992 | Lisec | |
| 5,295,292 | A | 3/1994 | Leopold | |
| 5,361,476 | A | 11/1994 | Leopold | |
| 5,423,935 | A * | 6/1995 | Benecke et al. | 156/291 |
| 5,932,062 | A | 8/1999 | Manser | |
| 6,017,578 | A * | 1/2000 | Trautmann et al. | 427/8 |
| 6,055,783 | A | 5/2000 | Guhl et al. | |
| 6,197,231 | B1 | 3/2001 | Lisec | |
| 6,286,288 | B1 | 9/2001 | France | |
| 6,296,708 | B1 * | 10/2001 | Coulibaly et al. | 118/679 |
| 6,368,408 | B1 | 4/2002 | Schuler | |
| 6,401,428 | B1 | 6/2002 | Glover et al. | |
| 6,494,245 | B1 | 12/2002 | Simone | |

FOREIGN PATENT DOCUMENTS

| | | |
|---|---|---|
| EP | 0 252 066 A1 | 1/1988 |
| EP | 0 709 539 | 5/1996 |
| EP | 1 213 431 A2 | 6/2002 |
| EP | 1 297 901 A2 | 4/2003 |

* cited by examiner

*Primary Examiner*—Fred J. Parker
(74) *Attorney, Agent, or Firm*—Watts Hoffmann Co, LPA

(57) ABSTRACT

The system includes a nozzle, a drive, a metering pump, a supply of material and a controller. The nozzle dispenses material into contact with one or more surfaces of a window sash. The drive relatively moves the nozzle with respect to the window sash along a path of travel defined by a perimeter of the window sash at controlled speeds. The metering pump delivers the material to the nozzle at controlled volumetric rates that correspond to the controlled speeds of relative motion between the nozzle and the sash. The supply of material delivers the material to the metering pump. The controller controls the relative motion between the window sash and the nozzle and controls the flow rate of material dispensed by the nozzle.

14 Claims, 19 Drawing Sheets

CONTROLLED DISPENSING OF MATERIAL

RELATED APPLICATION

The present invention is a continuation-in-part of U.S. patent application Ser. No. 09/733,272, filed Dec. 8, 2000, entitled "CONTROLLED DISPENSING OF MATERIAL", now U.S. Pat. No. 6,630,028.

FIELD OF THE INVENTION

The present invention relates to window units and, more particularly, to a method and apparatus for applying adhesive/sealant, desiccant, desiccated sealant and/or a coating to window sashes used in window units.

BACKGROUND OF THE INVENTION

Insulating glass units (IGU's) have been used in windows to reduce heat loss from building interiors during cold weather or to reduce heat gain in building interiors during hot weather. IGU's are typically formed by a spacer assembly that is sandwiched between glass lites. The spacer assembly usually comprises a frame structure that extends peripherally around the unit, an adhesive material that adheres the glass lites to opposite sides of the frame structure, and desiccant in an interior region of the frame structure for absorbing atmospheric moisture within the IGU. The glass lites are flush with or extend slightly outwardly from the spacer assembly. The adhesive is disposed on opposite outer sides of the frame structure about the frame structure periphery, so that the spacer is hermetically sealed to the glass lites. An outer frame surface that defines the spacer periphery may also be coated with sealant, which increases the rigidity of the frame and acts as a moisture barrier.

One type of spacer construction employs a "U" or rectangular shaped, roll formed aluminum or steel element that Is bent and connected at its two ends to form a square or rectangular spacer frame. Opposite sides of the frame are covered with an adhesive (e.g., a hot melt material) for securing the frame to the glass lites. The adhesive provides a barrier between atmospheric air and the IGU interior which blocks entry of atmospheric water vapor. Desiccant is deposited in an interior region of the U-shaped frame element. The desiccant is in communication with the air trapped in the IGU interior and removes any entrapped water vapor and thus impedes water vapor from condensing within the IGU. After the water vapor entrapped in the IGU is removed, internal condensation only occurs when the seal between the spacer assembly and the glass lights fails or the glass lights are cracked.

Prior art systems for applying adhesive to outer surfaces of a spacer and desiccant to an inner region of the spacer are pressure-based systems. Desiccant or adhesive under pressure is supplied from a bulk supply, such as a 55-gallon drum by a piston driven pump. A hose delivers the desiccant or adhesive in response to actuation of the piston driven pump to an inlet of a compensator. The compensator allows a user to select a desired pressure that will be provided at the outlet of the compensator. When the pressure at the outlet of the compensator is less than the selected pressure, the desiccant or adhesive material under pressure supplied to the inlet of the compensator causes the piston to move from a "closed" position to an "open" position. Movement of the compensator piston to the "open" position allows the material under pressure supplied to the compensator inlet to flow toward the outlet until the pressure at the outlet reaches the selected pressure. When the pressure at the outlet reaches or slightly exceeds the selected pressure, the material under pressure at the outlet of the compensator forces the piston back to the "closed" position, stopping material flow from the compensator inlet to the outlet.

Prior art systems include needle valves that dispense the material into contact with spacer frames. The needle valves are adjustable by the user to control the flow rate of the desiccant or adhesive. The flow of the desiccant or adhesive material is determined by the orifice size of the needle valve and the viscosity and pressure of the material. The pressure of the adhesive or desiccant material is dependent on several variables, including viscosity, temperature, nozzle size, and batch to batch variations of the dispensed material. Because so many variables are involved, the amount of desiccant or adhesive dispensed is subject to a fairly wide fluctuation due to pressure changes that are attributable to various factors mentioned above.

Pressure-based application systems require the operator to constantly adjust for flow. Often, an excessive amount of material is dispensed to ensure that under all conditions an adequate amount of material is applied to the spacer frame. If the dispensing system is down for more than a few minutes, the system has to be purged due to an increased viscosity of the desiccant or adhesive that has cooled. The increased viscosity of the material that has been allowed to cool makes it difficult to pass the material through the nozzle and flow material through the system.

Multipane window units have been proposed that do not include an insulating glass unit. The glass panes of these multipane window units are attached directly to a sash assembly. Sash assemblies generally have a closed perimeter that may define a square, rectangle, circle, oval or other shape. Application of sealant and/or desiccant to a sash assembly is difficult because the sealant and/or desiccant is applied along a nonlinear application path defined by the sash perimeter. In the case of rectangular sash assemblies, the application path includes right angles that may require the sealant and/or desiccant to be applied at variable rates.

One problem, identified by the inventor of the present application, with multipane window units that do not include an insulating glass unit is that sash assemblies are often made from a porous material. As a result, moisture may pass through the sash assembly into the region between the glass panes. This moisture will result in condensation inside the multipane window unit.

The prior art pressure based adhesive and/or desiccant application systems are not configured to apply adhesive and/or desiccant along a non-linear path or apply adhesive and/or desiccant at variable rates. In addition, prior art sash assemblies do not include a film or coating that prevents moisture from entering the multipane window unit.

SUMMARY OF THE INVENTION

The present invention concerns a system for controlled dispensing of material onto a window sash. The system includes a dispensing nozzle, a drive, a metering pump, a supply, and a controller. The nozzle is adapted to dispense material into contact with one or more surfaces of the window sash. The drive relatively moves the nozzle with respect to the window sash along a path of travel defined by a perimeter of the window sash at controlled speeds. The metering pump delivers the material to the nozzle at controlled rates that correspond to the controlled speeds of relative motion between the nozzle and the window sash. The supply delivers the material to an inlet of the metering pump. The controller controls the drive to control the relative motion between the nozzle and window sash. The controller also controls the flow rate Of material dispensed by the nozzle.

In one embodiment, the drive moves the nozzle. A nozzle carrying assembly of the drive may be positioned inward of the perimeter of the window sash or outward of the, perimeter of the window sash. The path of travel of the nozzle may be determined by an optical sensor coupled to the controller. The optical sensor detects edges of the sash that the controller uses to determine the path of travel as material is dispensed. In another embodiment, the path of travel is provided to the controller by a bar code reader, The bar code reader reads a bar: code on the window sash that indicates a size and/or shape of the sash that the controller uses to determine the path of travel.

In one embodiment the metering pump is a gear pump. The controller controls an angular velocity of a gear of the gear pump based on a relative linear speed of the nozzle with respect to the window sash to deliver a substantially constant volume per unit length of material along the path of travel. In one embodiment, one nozzle applies material to a first side of the sash and a second nozzle applies material to a second side of the window sash.

In one embodiment, a pressure transducer monitors the pressure of the material before the material is dispensed from the nozzle. The pressure transducer may be positioned for monitoring pressure at an inlet side of the metering pump. The controller regulates pressure of the material delivered to the metering pump from the supply of material based on the pressure monitored by the pressure transducer. In this embodiment, the controller includes an output coupled to a bulk supply for adjusting the pressure of the material to minimize a pressure drop between the inlet of the metering pump and the outlet of the metering pump.

In one embodiment, the nozzle includes first and second outlets that apply first and second materials to the window sash. In this embodiment, the first and second material may be blended as they are dispensed. In one embodiment, the first material is a sealant or adhesive such as polyisobutylene for reducing penetrating moisture and the second material is a structural adhesive or sealant.

The disclosed system allows material to be dispensed around a perimeter of a window sash in a controlled manner. The material dispensing nozzle is relatively moved with respect to the window sash along a path of travel defined by a perimeter of the window at controlled speeds. Material is delivered from the supply of material to the inlet of the metering pump. The metering pump is operated to deliver the material to the dispensing nozzle at controlled volumetric rates based on the controlled speeds of relative motion between the nozzle and the window sash. The material is dispensed into contact with the window sash through the nozzle.

In one embodiment, an insulating glass unit is constructed using a sash member that is covered with a low porosity film or coating. Such an insulating glass unit includes a sash member made from a relatively porous material. Such relatively porous materials include polyvinylchloride (PVC). The sash includes a glass supporting portion with first and second glass supporting surfaces. A low porosity coating or film is disposed over the glass supporting portion of the sash member. An adhesive and/or sealant is disposed on a portion of the first and second glass supporting surfaces. A pair of glass lites are adhered to the first and second glass supporting surfaces by the adhesive. A desiccant may be applied to a surface of the coating that is within the multipane glass unit. In the alternative, a desiccated sealant could be used to remove moisture from inside the unit.

One system for applying a film or coating to a portion of a window sash that supports glass lites includes a conveyor for moving elongated window sash members. The system includes a supply of an elongated strip of covering material for controlled application onto specified surfaces of a sash member. The covering material includes an adhesive for adhering the covering material to a sash. A drive system moves the covering material into contact with sash members to cause the covering material to overlie and adhere to a surface of the sash member. A pressure roll applies pressure to a region of engagement between the sash members and the covering material.

In one embodiment, the covering material is a multiple layer material. One of the covering material layers is a carrier layer that is separated from one or more other layers of the strip of covering material when the other layers are applied to the sash member. In this embodiment, the system includes a recoiler for winding the carrier layer up after application of the covering layer to the sash member.

In a process for applying a coating to a glass supporting portion of a window sash, an elongated window sash member is provided having an exposed surface. An elongated strip of covering material is provided for controlled application onto a specified portion of the exposed surface of the sash member. The elongated strip of covering material includes an adhesive for adhering the covering material to the sash member. The covering material is brought to the sash member and is caused to overlie and adhere to the sash member.

Additional features of the invention will become apparent and a fuller understanding obtained by reading the following detailed description in connection with the accompanying drawings.

BEST MODE FOR CARRYING OUT THE INVENTION

Figure 1:
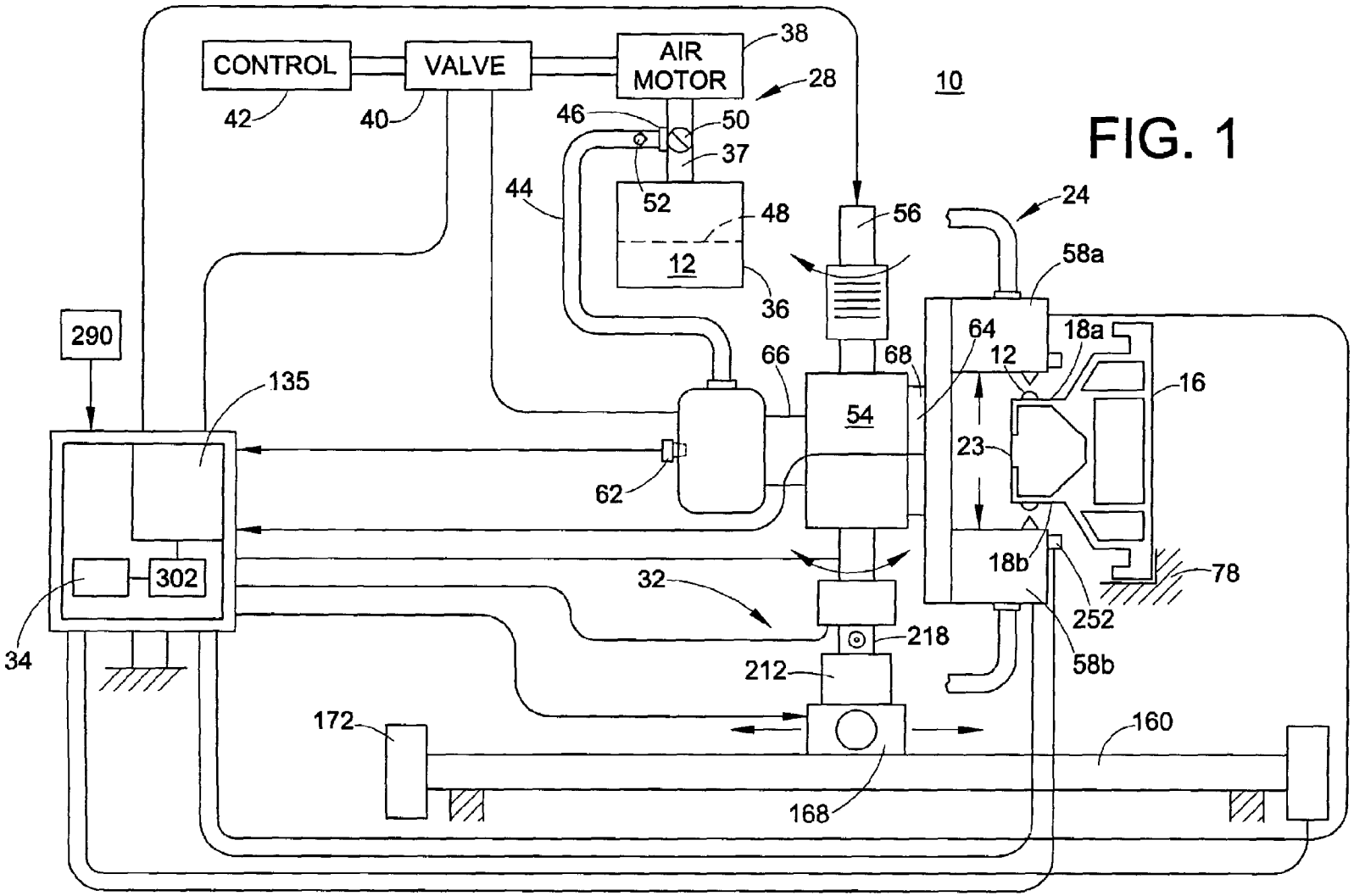
FIG. 1 is a schematic representation of a system for applying adhesive and/or desiccant to window sashes used in constructing multipane windows.

The present invention is directed to a system 10 for controlled dispensing of an adhesive and/or sealant 12 onto a window sash 16. This application contemplates dispensing of adhesives and sealants. It should be readily apparent to those skilled in the art that structural adhesives and moisture inhibiting sealants could be substituted for one another or modified to create an appropriate bond and seal between a glass pane and a window sash. Use of the term adhesive is meant to generally identify an adhesive or sealant. Likewise, use of the term sealant is meant to generally identify sealant, an adhesive, and/or a desiccated sealant. Referring to FIG. 1, the system 10 applies adhesive 12 to glass abutting surfaces 18*a*, 18*b* of the window sash 16. In one embodiment, the system 10 also applies desiccant 14 into an interior region 22 (FIG. 4B) of the window sash 16. The adhesive 12 on the glass abutting surfaces 18*a*, 18*b* facilitates attachment of glass lites 20 of an assembled insulating glass unit. The desiccant 14 applied to the interior region 22 of the window sash 16 captures any moisture that is trapped within-an assembled multipane window unit 19. In a; second embodiment, desiccant is applied to innermost surface 23 of the sash 16 (FIG. 4A).

Referring to FIGS. 4A, 4B, 5A and 5B, in one embodiment a covering material, is disposed on the window sash 16 of an insulating glass unit 19. The covering material 410 is included when the sash 16 is made from a porous material, such as vinyl or PVC. The covering material 410 is a low porosity thin film or coating that prevents moisture from migrating into the window unit through the porous sash. Examples of acceptable materials for the film or coating include thin metal coatings and Tyvek® foil. In this embodiment, the system 10 may include a station 400 (FIG. 16) for applying a film or coating material to the sash or sashes may be provided with the film or coating from an outside source.

Figure 5A:
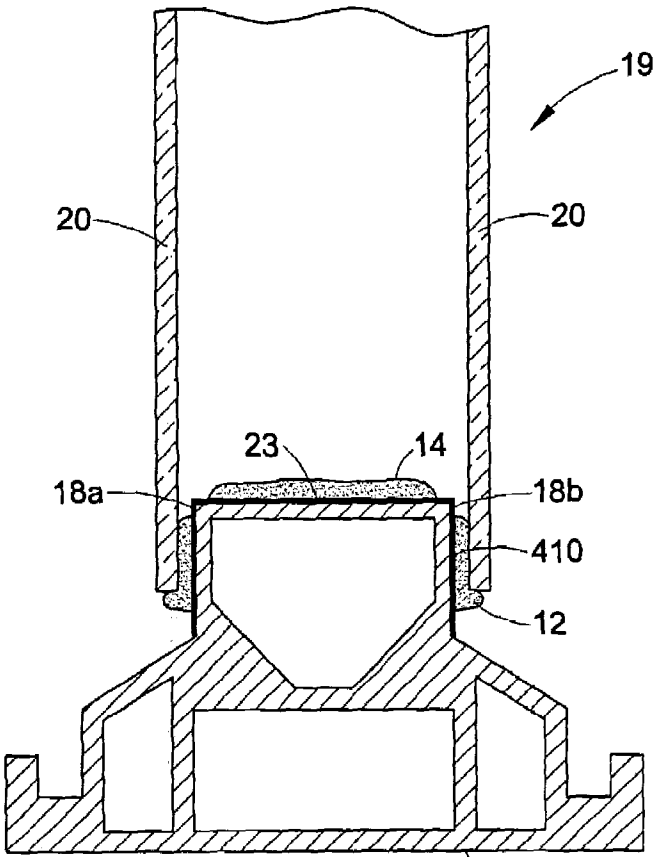
FIG. 5A is a sectional view of a portion of a multipane window unit.
Figure 4A:
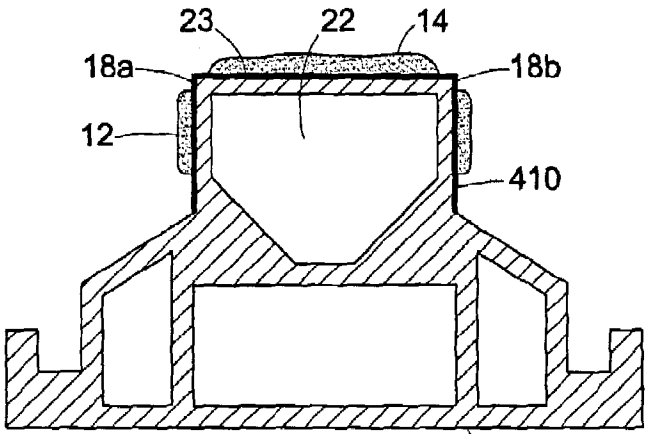
FIG. 4A is a sectional view of a window sash with adhesive, desiccant, and a low porosity film applied to it.

FIGS. 4A and 5A illustrate a sash that includes two glass abutting surfaces 18*a*, 18*b* that are connected by an innermost surface 23. In the embodiment illustrated by FIGS. 4A and 5A, the covering material 410 is disposed on the surface 23 and surfaces 18*a*, 18*b*. Adhesive and/or sealant 12 is applied to the covering material 410 on the surfaces 18*a*, 18*b*. Desiccant is applied to the covering material 410 over the surface 23.

Figure 4C:
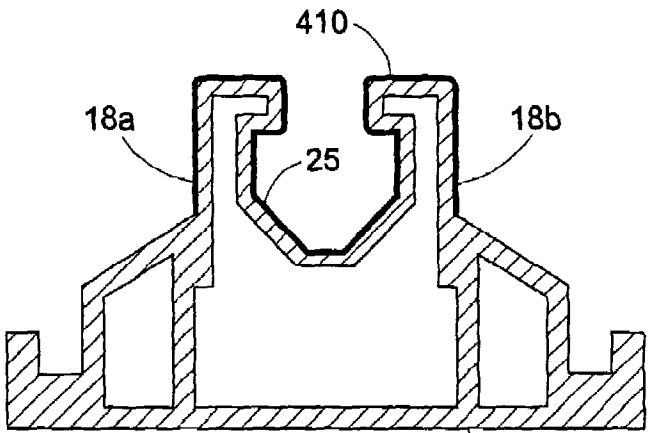
FIG. 4C is a sectional view of a window sash with a sprayed on vapor barrier applied to it.
Figure 5B:
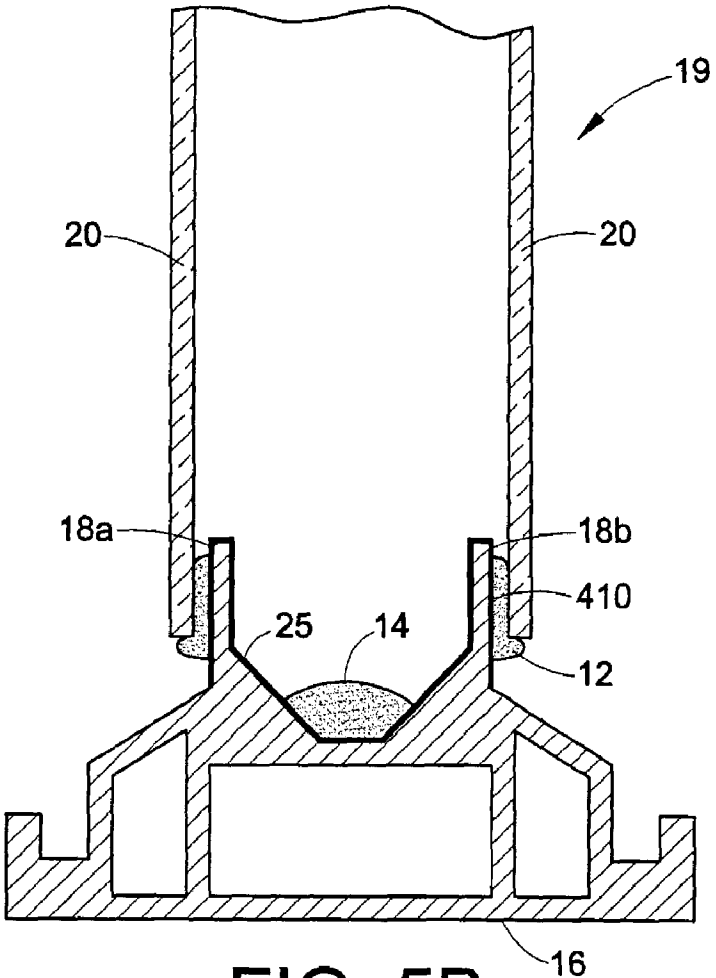
FIG. 5B is a sectional view of a portion of a multipane window unit.
Figure 4B:
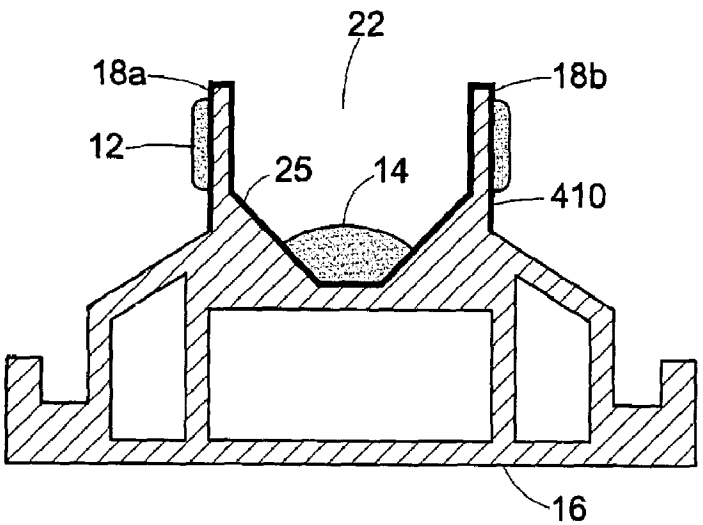
FIG. 4B is a sectional view of a window sash with adhesive, desiccant, and a low porosity film applied to it.

FIGS. 4B, 4C and 5B illustrate one embodiment where the desiccant is not in plain view from outside the glass unit 10. In this embodiment, the a sash 16 includes segments that define a concave inner surface 25. In the embodiment illustrated by FIGS. 4B and 5B, the covering material 410 is a film is disposed on the surfaces 18*a*, 18*b* and the concave inner surface 25. In the embodiment illustrated by FIG. 4C, the covering material 410 is a sprayed on coating on the surfaces 18*a*, 18*b* and the, concave inner surface 25. Adhesive and/or sealant is applied to the covering material 410 on surfaces 18*a*, 18*b*. Desiccant is applied in the interior region 22 to the film or coating 410 that covers the concave inner surface.

Figure 2:
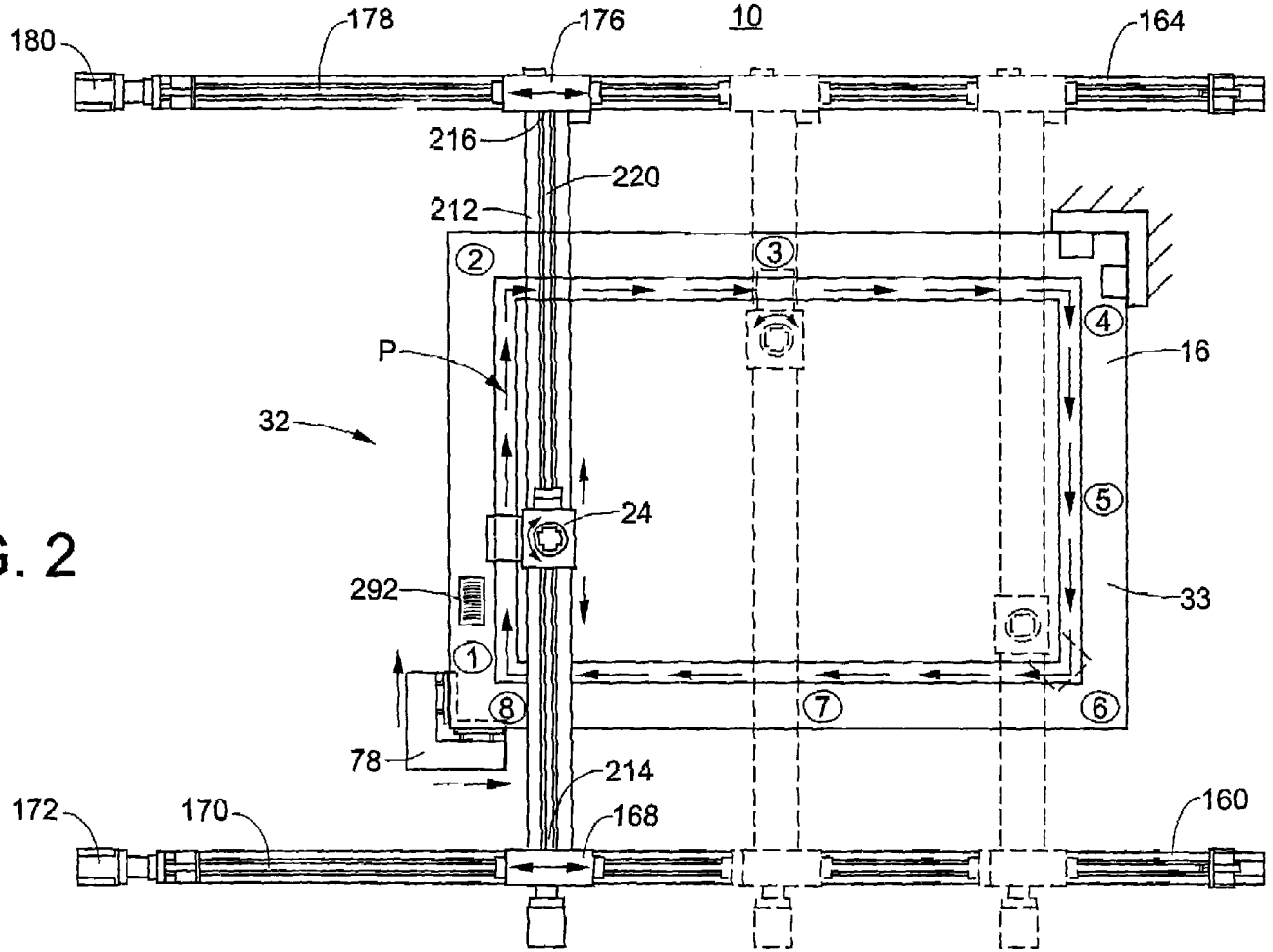
FIG. 2 is a schematic plan view of a system for applying adhesive/sealant to a window sash.
Figure 3A:
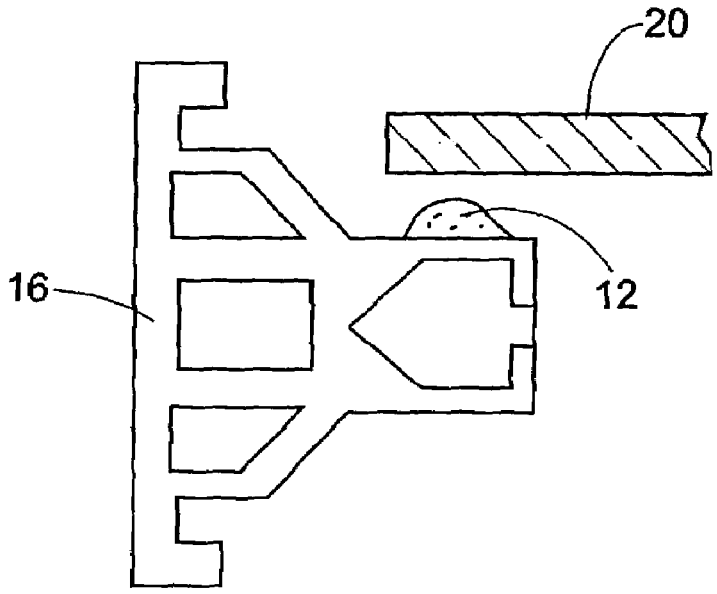
FIG. 3A is a side elevational view of a glass lite positioned above a window sash.
Figure 3B:
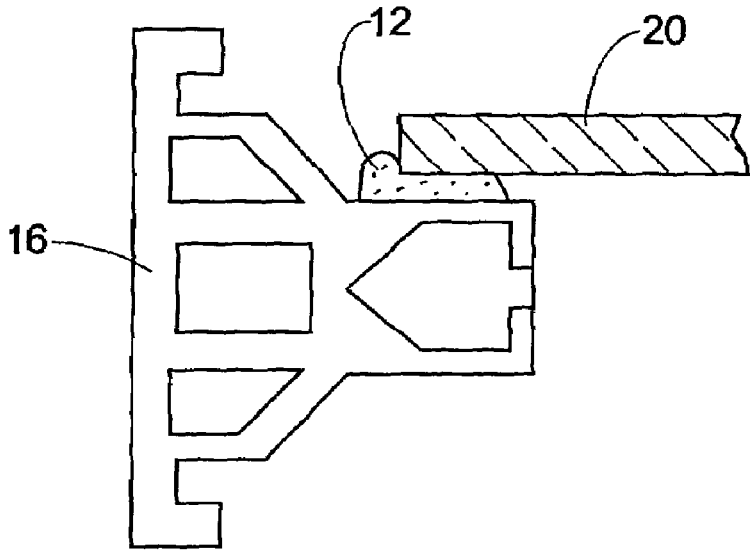
FIG. 3B is a side elevational view of a glass lite pressed onto sealant previously dispensed onto a window sash.

Referring to FIG. 1, the dispensing system 10 includes an adhesive metering and dispensing assembly 24, an adhesive bulk supply 28, a drive 32 and a controller 34. The pressurized adhesive bulk supply supplies adhesive 12 under pressure to the adhesive metering and dispensing assembly 24. The adhesive metering and dispensing assembly 24 senses pressure of the adhesive 12 supplied by the adhesive supply 28. The controller 34 regulates the pressure of the adhesive 12 delivered to the adhesive metering and dispensing assembly 24 based on the pressures sensed by the adhesive metering and dispensing assembly 24. The drive 32 relatively moves the adhesive dispensing assembly with respect to window sash 16 along a path P (FIG. 2) of travel at controlled speeds. The path of travel is defined by the glass abutting surfaces 18*a*, 18*b* around the perimeter 33 of the sash 16. The controller controls the drive 32 to control the relative motion between the nozzle and the window sash. The controller also controls the adhesive metering and dispensing assembly 24 to control the flow rate of material dispensed onto the glass abutting surfaces 18*a*, 18*b*. In the exemplary embodiment, the controller 34 uses the relative speed of the metering and dispensing assembly 24 with respect to the window sash 16 to determine the flow rate of material dispensed, so that a substantially constant volume per unit length is dispensed on the glass abutting surfaces 18*a*, 18*b*.

Adhesive Application

In the exemplary embodiment, the adhesive metering and dispensing assembly 24 includes an adhesive metering pump 54 which is a gear pump in the exemplary embodiment. The speed of the adhesive dispensing gear pump 54 is controlled to dispense the desired amount of adhesive to the window sash 16. In the illustrated embodiment, the adhesive metering and dispensing assembly is moved by the drive 32. The adhesive metering and dispensing assembly 24 applies the desired amount of adhesive 12 to the glass abutting walls 18*a*, 18*b* of the window sash 16 as the assembly 24 moves around the dispensing path P.

Referring to FIG. 1, the adhesive bulk supply 28 includes a reservoir 36 filled with adhesive 12, a shovel pump or similar mechanism 37, an air motor 38, an exhaust valve 40, an electropneumatic regulator 42 or control, and a hose 44. Shovel pump mechanisms are well known in the art. One acceptable shovel pump mechanism 37 is model no. MHMP41024SP, produced by Glass Equipment Development. The adhesive electropneumatic regulator 42 regulates the pressure applied to the adhesive 12 by the air motor 38. One acceptable electropneumatic regulator 42 is model no. QB1TFEE100S560-RQ00LD, produced by Proportion-Air. The hose 44 extends from an output 46 of the shovel pump mechanism 37 to an inlet 66 of the adhesive gear pump 54. In the exemplary embodiment, the adhesive reservoir 36 is a 55 gallon drum filled with adhesive 12. One acceptable adhesive that could be used is HL-5153, distributed by HB-Fuller. This sealant is characterized as being flexible, temperature resistant and able to withstand high shear forces. It should be readily apparent that other sealants could be used. In an alternate embodiment, two bulk supplies 28 are used to allow continued operation of the system 10 while the material reservoir of one of the bulk supplies is being changed.

Figure 7:
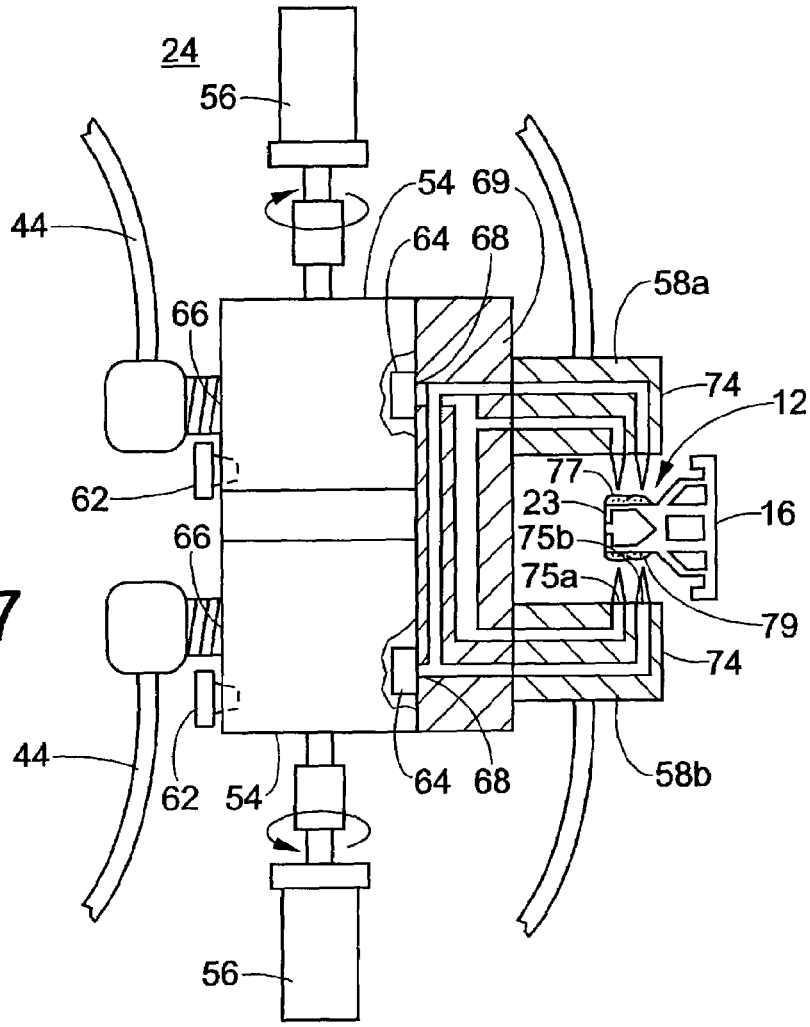
FIG. 7 is a front elevational view of a sealant and a structural adhesive being applied to a window sash.

Two bulk supplies 28 could be used to supply two different adhesives and/or sealants to provide a dual seal (see FIG. 7). For example, sealants with hot melt properties could be supplied with a dual seal equivalent, polyisobutelyne could be supplied with hot melt or polyisobutelyne could be supplied with a dual seal equivalent. In one embodiment, H. B. Fuller materials HL5143 and HL5153 are provided by two bulk supplies. It should be readily apparent that other sealant materials could be used.

When the air motor 38 is activated, a piston (not shown) included in the shovel pump mechanism 37 is pushed down into the reservoir 36 by the air motor 38. The shovel pump mechanism 37 includes a plate 48 which forces the material upward into a valving system 50. The shovel pump mechanism 37 delivers adhesive 12 under pressure to the hose 44. In the exemplary embodiment, the shovel pump mechanism 37 heats the adhesive 12 to condition it for the adhesive metering and dispensing assembly 24. However, not all the materials need to be heated. To stop applying additional pressure to the adhesive 12 in the reservoir 36, the exhaust valve 40 is selectively opened by the electropneumatic regulator or control 42.

Most manufacturing facilities generate up to approximately 100 psi of air pressure. In the exemplary embodiment, the piston to diameter ratio of the shovel pump mechanism 37 amplifies the air pressure provided by the manufacturing facility by a factor of 42 to 1. Magnification of the facility's available air pressure enables the shovel pump mechanism 37 to supply adhesive 12 at a maximum pressure of 4200 psi to the adhesive hose 44.

In the exemplary embodiment, the adhesive hose 44 is a 1 inch diameter insulated hose and is approximately 10 feet long. The pressure of the adhesive 12 as it passes through the hose 44 will drop approximately 1000 psi as it passes through the hose, resulting in a maximum adhesive pressure of 3200 psi at the inlet of the adhesive metering and dispensing assembly 24. The shovel pump mechanism 37 includes a check valve 52 in the exemplary embodiment. When the pressure of the adhesive 12 supplied by the shovel pump mechanism 37 is greater than the pressure of the adhesive 44 in the hose, the check valve 52 will open, allowing adhesive 12 to escape from the adhesive bulk supply 28 to the hose 44 to reduce the pressure of the adhesive in the bulk supply.

Figure 6:
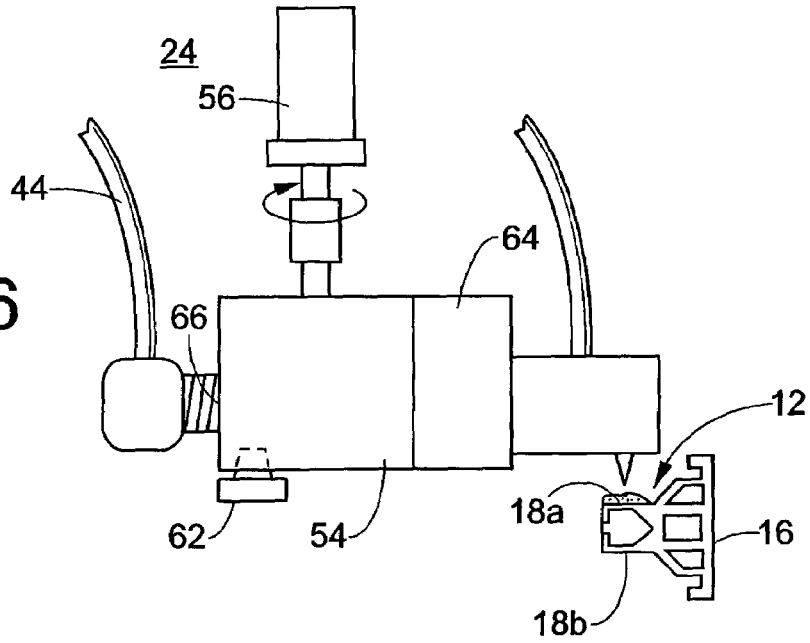
FIG. 6 is a schematic view of an adhesive being applied to one side of a window sash by a nozzle.

Referring to FIGS. 1 and 7, the adhesive metering and dispensing assembly 24 includes an adhesive gear pump 54, an adhesive gear pump motor 56, first and second side dispensing nozzles 58*a*, 58*b*, an inlet pressure sensor 62 and an outlet pressure sensor 64. FIG. 6 illustrates one embodiment where a single dispensing gun 58 is included that applies adhesive 12 to one glass abutting surface 18*a* of the window sash 16. Referring to FIG. 1, adhesive 12 is supplied under pressure by the adhesive bulk supply 28 via the hose 44 to an inlet 66 of the adhesive gear pump 54. Controlled rotation of the gears of the adhesive gear pump 54 by the motor 56 meters adhesive 12 and supplies the desired amount of adhesive 12 to the dispensing guns 58*a*, 58*b* through a gear pump outlet 68.

Figure 8:
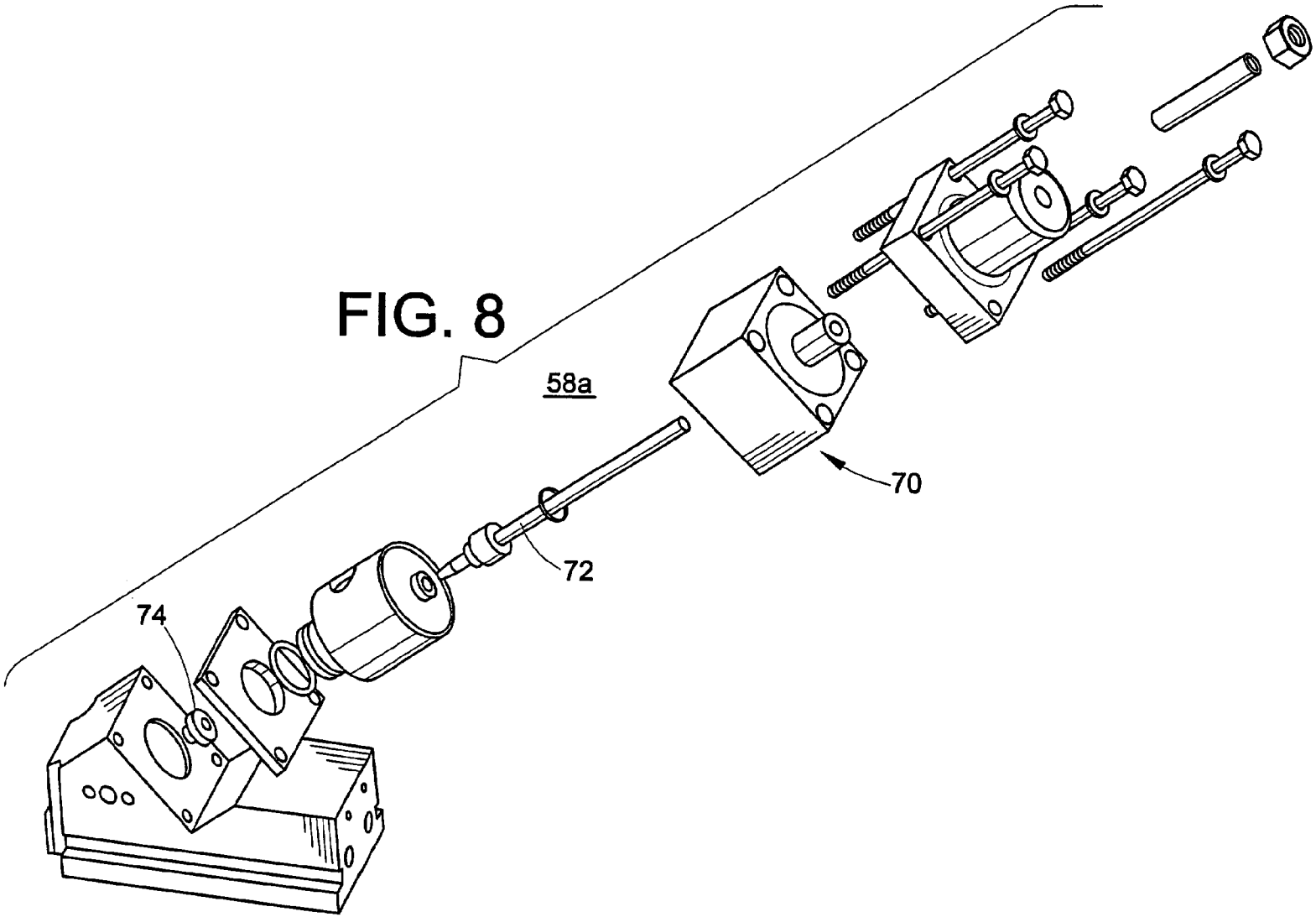
FIG. 8 is an exploded perspective view of an adhesive dispensing gun.

FIG. 8 illustrates an adhesive dispensing gun 58*a*. Only dispensing gun 58*a* is illustrated, since guns 58*a* and 58*b* are substantially identical. Dispensing gun 58*a* is a needle valve-type dispenser that utilizes an air cylinder 70 to apply a force on a stem 72, pushing the stem 72 against a sealing seat (not shown) of a nozzle 74 when the valve is closed. To dispense the adhesive 12, a solenoid valve causes the air cylinder 70 to move the stem 72 away from the sealing seat of the nozzle 74, allowing adhesive 12 to flow through an open orifice of the nozzle 74. One suitable dispensing gun is model no. 2-15210 manufactured by Glass Equipment Development.

Referring to FIGS. 1 and 7, the side dispensing guns 58*a*, 58*b* apply adhesive and/or sealant to the surfaces 18*a*, 18*b* of the window sash 16 in one embodiment. In one embodiment, the adhesive is a polyisobutylene material. A polyisobutylene material provides a very reliable vapor blocking seal between the sides 18*a*, 18*b* of the spacer 16 and the glass lights. In another embodiment, the side adhesive nozzles are adapted to apply a DSE (Dual Seal Equivalent) material such as HL5142 or HL5153, manufactured by H. B. Fuller, to the sides 18*a*, 18*b* of the spacer 16.

In one embodiment, illustrated by FIG. 7, the side nozzles: are adapted to apply two adhesives to each glass abutting surface 18*a*, 18*b*. The nozzles 74 each include two orifices 75*a*, 75*b* for blending and applying two types of material to the surfaces 18*a*, 18*b* of the window sash 16. The adhesives-are shown in FIG. 7 as distinct masses for illustrative purposes. In the exemplary embodiment, the two materials flow into one another as they are applied such that the intersection of the two materials may be somewhat blended. In one embodiment, a primary sealant 77, such as polyisobutylene (PIB) is applied near the innermost surface 23 and a secondary structural sealant 79 is applied to the outer portion of the glass abutting surfaces 18*a*, 18*b*. PIB has an excellent moisture barrier path resistance that impedes moisture from migrating through the to the inside of the unit that can cause the dew point to increase, causing a failure in an IG unit. The secondary sealant may be modified polyurethane that is heat or moisture cured. The dual seal construction is a more durable seal. The segments are blended together as they are applied to avoid cracks or voids between the different types of material.

In one embodiment, the secondary structural seal is a UV cured material. A UV cured sealant allows cold pressing of the multipane window unit, saving time, energy and equipment. Use of UV cured sealant eliminates expansion of trapped air inside the unit, eliminating the need for a vent hole, that is later sealed with a screw or rivet and a patch seal. A UV sealant can be cured almost instantaneously, allowing work in process to be reduced in the plant. This also eliminates a cool down period that is typically associated with hot melt or hot applied sealant.

In one embodiment, the sealant is a desiccated sealant. A desiccated sealant includes desiccant material intermixed with the sealant material. The desiccant sealant that is inside the window unit traps moisture that may be inside the window unit. Use of a desiccant sealant may eliminate the need to apply a separate desiccant inside the window unit.

In the exemplary embodiment, the volumetric flow rate of the adhesive 12 dispensed by the adhesive metering and dispensing assembly 24 is precisely controlled by controlling the speed of the adhesive gear pump motor 56, which drives the adhesive gear pump 54. As long as material is continuously supplied to the inlet of the gear pump 54, a known amount of adhesive 12 is dispensed for every revolution of the gear pump 54. In the exemplary embodiment, the adhesive metering and dispensing assembly 24 includes a manifold which delivers the adhesive 12 from the hose 44 to the gear pump 54 and delivers the adhesive 12 from the gear pump 54 to the dispensing guns 58*a*, 58*b*. In the exemplary embodiment, the gear pump 54 provides 20 $cm^3$ of adhesive 12 per revolution of the gear pump. One suitable gear pump is model no. BAS-20, manufactured by Kawasaki.

Depending on the adhesive selected, the pressure of the adhesive 12 supplied to the gear pump 54 is controlled between approximately 600 psi and 1500 psi in the exemplary embodiment. If the pressure of the adhesive 12 supplied to the adhesive gear pump 54 is less than approximately 200 psi, the gear pump 54 will have a tendency to cavitate, resulting in voids in the dispensed adhesive 12. If the pressure of the adhesive 12 supplied to the gear pump 54 exceeds approximately 2000 psi, the gear pump 54 or dispensing guns 58*a*, 58*b* may he damaged. In the exemplary embodiment, the software that controls the pressure of the adhesive supplied to the gear pump protects the dispensing guns and the gear pump.

In the exemplary embodiment, the inlet pressure sensor 62 monitors the pressure of the adhesive 12 at the inlet 66 of the gear pump 54. In the exemplary embodiment, the inlet pressure sensor 62 is model no. 891.23.522, manufactured by WIKA Instrument. The inlet pressure sensor 62 is in communication with the controller 34 which is in communication with the electropneumatic regulator 42 of the adhesive bulk supply 28. The pressure of the, adhesive 12 at the inlet 66 of the gear pump 54 quickly drops when, adhesive 12 is being dispensed through the nozzle 74. When the adhesive pressure sensed by the inlet pressure sensor 62 is below the desired pressure (typically between 600 psi and 1500 psi) the controller 34 provides a signal to the electropneumatic regulator 42 of the adhesive bulk supply control 42, causing the air motor 38 to apply air pressure to the shovel pump mechanism 37, thereby increasing the pressure of the adhesive 12 supplied by the hose 44 to the inlet 66, of the adhesive gear pump 54. When the pressure of the adhesive 12 at the inlet 66 is greater than the desired pressure, the controller 34 provides a signal to the electropneumatic regulator 41 of the adhesive bulk supply control 42 causing the regulator exhaust valve 40 to vent, thereby preventing the pressure of the adhesive supplied by the hose 44 from increasing further. The pressure of the adhesive 12 is not reduced when the exhaust valve 40 of the regulator 38 is vented. The pressure of the adhesive 12 is reduced by dispensing adhesive 12 in the exemplary embodiment.

In one embodiment, the dispensing system 10 minimizes the difference in adhesive pressure between the inlet 66 and outlet 68 of the gear pump 54. In this embodiment, the inlet pressure sensor 62 monitors the pressure of the adhesive 12 at the inlet 66 of the gear pump 54 and the outlet pressure sensor 64 monitors the adhesive pressure 12 at the outlet 68 of the gear pump 54 in one of the adhesive dispensing guns or the manifold 69. The signals of the inlet pressure sensor and the outlet pressure sensor are provided to the controller 34. In this embodiment, the controller 34 provides a signal that causes the adhesive bulk supply 28 to increase the pressure of the adhesive 12 supplied when the pressure at the inlet of gear pump 54 is less than the pressure at the outlet of the gear pump 54. The controller 34 provides a signal to the adhesive bulk supply 28 which causes the adhesive bulk supply 28 to stop adding pressure to the adhesive 12 when the pressure at the inlet is greater than the pressure at the outlet.

In the exemplary embodiment, the inlet pressure sensor 62 provides an analog output which ranges from 4 mA to 20 mA to the controller 34. This signal corresponds linearly with an adhesive gear pump 54 inlet pressure range of 0 psi to 2000 psi. If the pressure at the inlet of the adhesive gear pump is lower than a programmed pressure set point, the controller output will apply a voltage signal that causes the pressure of the adhesive at the inlet of the gear pump to increase. The further the actual pressure is from the programmed set point pressure, the more aggressively the voltage signal is applied and the more aggressively pressure is increased at the inlet of the adhesive gear pump. If the pressure sensed at the inlet of the adhesive gear pump is greater than the set point pressure, the adhesive regulator will receive an OV signal and exhaust. For example, the air motor 38 will add pressure to the adhesive 12 much more rapidly in response to a 4 mA inlet pressure sensor signal than to an inlet pressure sensor signal that is slightly less than 12 mA.

In the exemplary embodiment, when the inlet pressure sensor signal is greater than 12 mA, and the corresponding controller signal is less than 5 volts, the electropneumatic regulator 42 will cause the exhaust valve 40 to exhaust in a scaled manner to prevent additional pressure from being created in the adhesive 12. A 20 mA signal and corresponding 0 volt signal provided by the inlet pressure sensor 62 and controller will cause the exhaust valve 40 to exhaust much more quickly than sensor and controller signals which arc slightly higher than 12 mA and slightly lower than 5 volts.

Desiccant Application

Figure 20:
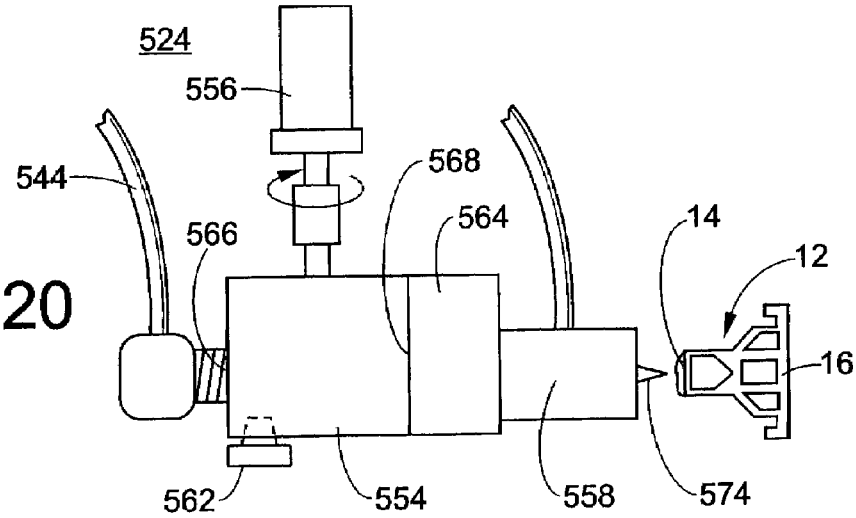
FIG. 20 is a schematic view of a desiccant being applied to a window sash by a nozzle of a desiccant dispensing head.

Referring to FIG. 20, desiccant 14 may be applied to the sash 16 in generally the same manner adhesive is applied to the sash. The dispensing assembly 24 may include an additional nozzle (not shown) for applying desiccant or a separate desiccant material and dispensing assembly 524 may be used to applying the desiccant in a separate step. Such a desiccant metering and dispensing assembly 524 includes a desiccant metering pump 554 which is a gear pump in the exemplary embodiment. The speed of the desiccant dispensing gear pump 554 is controlled to dispense the desired amount of desiccant to the window sash 16. In the illustrated embodiment, the desiccant metering and dispensing assembly is moved by a drive. The desiccant metering and dispensing assembly 524 applies the desired amount of desiccant 14 to the window sash 16 as the assembly 524 moves around a dispensing path P.

Like the disclosed adhesive bulk supply, a desiccant bulk supply includes a reservoir filled with desiccant, a shovel pump or similar mechanism, an air motor, an exhaust valve, an electropneumatic regulator or control, and a hose. One acceptable shovel pump mechanism 37 is model no. MHMP41024SP, produced by Glass Equipment Development. The electropneumatic regulator regulates the pressure applied to the desiccant by the air motor. One acceptable electropneumatic regulator 42 is model no.

QB1TFEE100S560-RQ00LD, produced by Proportion-Air. The hose 544 extends from an output of the shovel pump mechanism to an inlet 566 of the desiccant gear pump 554. In the exemplary embodiment, the desiccant reservoir is a 55 gallon drum filled with desiccant. One acceptable desiccant is HL-5157, distributed by HB-Fuller. In an alternate embodiment, two bulk supplies are used to allow continued operation of the system 10 while the material reservoir of one of the bulk supplies is being changed. The desiccant bulk supply works in generally the same manner as the adhesive bulk supply.

As mentioned above, most manufacturing facilities generate up to approximately 100 psi of air pressure. The piston to diameter ratio of the shovel pump mechanism 37 amplifies the air pressure provided by the manufacturing facility by a factor of 42 to 1. Magnification of the facility's available air pressure enables the shovel pump mechanism to supply desiccant at a maximum pressure of 4200 psi to the hose 544.

In the exemplary embodiment, the hose 544 is a 1 inch diameter insulated hose and is approximately 10 feet long. The pressure of the desiccant as it passes through the hose 44 will drop approximately 1000 psi as it passes through the hose, resulting in a maximum adhesive pressure of 3200 psi at the inlet of the desiccant metering and dispensing assembly 524. The shovel pump mechanism includes a check valve in the exemplary embodiment. When the pressure of the desiccant supplied by the shovel pump mechanism is greater than the pressure of the desiccant in the hose, the check valve will open, allowing desiccant to escape from the desiccant bulk supply to the hose 544 to reduce the pressure of the desiccant in the bulk supply.

Referring to FIG. 20, the desiccant metering and dispensing assembly 524 includes a desiccant gear pump 554, a desiccant gear pump motor 556, a dispensing gun 558, an inlet pressure sensor 562 and an outlet pressure sensor 564. Desiccant is supplied under pressure by the desiccant bulk supply via the hose 544 to an inlet 566 of the desiccant gear pump 554. Controlled rotation of the gears of the desiccant gear pump 554 by the motor 556 meters desiccant and supplies the desired amount of desiccant to the dispensing gun 558 through a gear pump outlet. One suitable dispensing nozzle is model no. 2-15266 manufactured by Glass Equipment Development.

In the exemplary embodiment, the volumetric flow rate of the desiccant dispensed by the desiccant metering and dispensing assembly 524 is precisely controlled by controlling the speed of the desiccant gear pump motor 556, which drives the gear pump 554. As long as material is continuously supplied to the inlet of the gear pump 554, a known amount of desiccant is dispensed for every revolution of the gear pump 554. In the exemplary embodiment, the gear pump 54 provides 20 $cm^3$ of desiccant per revolution of the gear pump. One suitable gear pump is model no. BAS-20, manufactured by Kawasaki.

If the pressure of the desiccant supplied to the desiccant gear pump 554 is less than approximately 200 psi, the gear pump 554 will have a tendency to cavitate, resulting in voids in the dispensed desiccant. If the pressure of the desiccant supplied to the gear pump 554 exceeds approximately 2000 psi, the gear pump 554 or dispensing gun 58 may be damaged.

In the exemplary embodiment, the inlet pressure sensor 562 monitors the pressure of the desiccant at the inlet 566 of the gear pump 54. In the exemplary embodiment, the inlet pressure sensor 562 is model no. 891.23.522, manufactured by WIKA Instrument. The inlet pressure sensor 562 is in communication with the controller 34 which is in communication with the electropneumatic regulator of the desiccant bulk supply. The pressure of the desiccant 14 at the inlet 566 of the gear pump 554 quickly drops when desiccant is being dispensed through the nozzle 574. When the desiccant pressure sensed by the inlet pressure sensor 562 is below the desired pressure (typically between 600 psi and 1500 psi) the controller 34 provides a signal to the electropneumatic regulator 42 of the adhesive bulk supply control, causing the air motor to apply air pressure to the shovel pump: mechanism, thereby increasing the pressure of the desiccant 14 supplied by the hose 544 to the inlet 566 of the gear pump 554. When the pressure of the desiccant 14 at the inlet 566 is greater than the desired pressure, the controller 34 provides a signal to the electropneumatic regulator of the adhesive bulk supply control causing the regulator exhaust valve to vent, thereby preventing the pressure of the desiccant supplied by the hose 544 from increasing further. The pressure of the desiccant is not reduced when the exhaust valve of the regulator is vented. The pressure of the desiccant is reduced by dispensing desiccant 14 in the exemplary embodiment.

In one embodiment, the dispensing assembly minimizes the difference in desiccant pressure between the inlet 566 and outlet 568 of the gear pump 554. In this embodiment, the inlet pressure sensor 62 monitors the pressure of the desiccant at the inlet 566 of the gear pump 554 and the outlet pressure sensor 564 monitors the desiccants pressure at the outlet 568 of the gear pump 554 in one of the dispensing gun. The signals of the inlet pressure sensor and the outlet pressure sensor are provided to the controller 34. In this embodiment, the controller 34 provides a signal that causes the desiccant bulk supply to increase the pressure of the desiccant supplied when the pressure at the inlet of gear pump 554 is less than the pressure at the outlet of the gear pump 554. The controller 34 provides a signal to the desiccant bulk supply which causes the desiccant bulk supply to stop adding pressure to the desiccant when the pressure at the inlet is greater than the pressure at the outlet.

Drive

Figure 10:
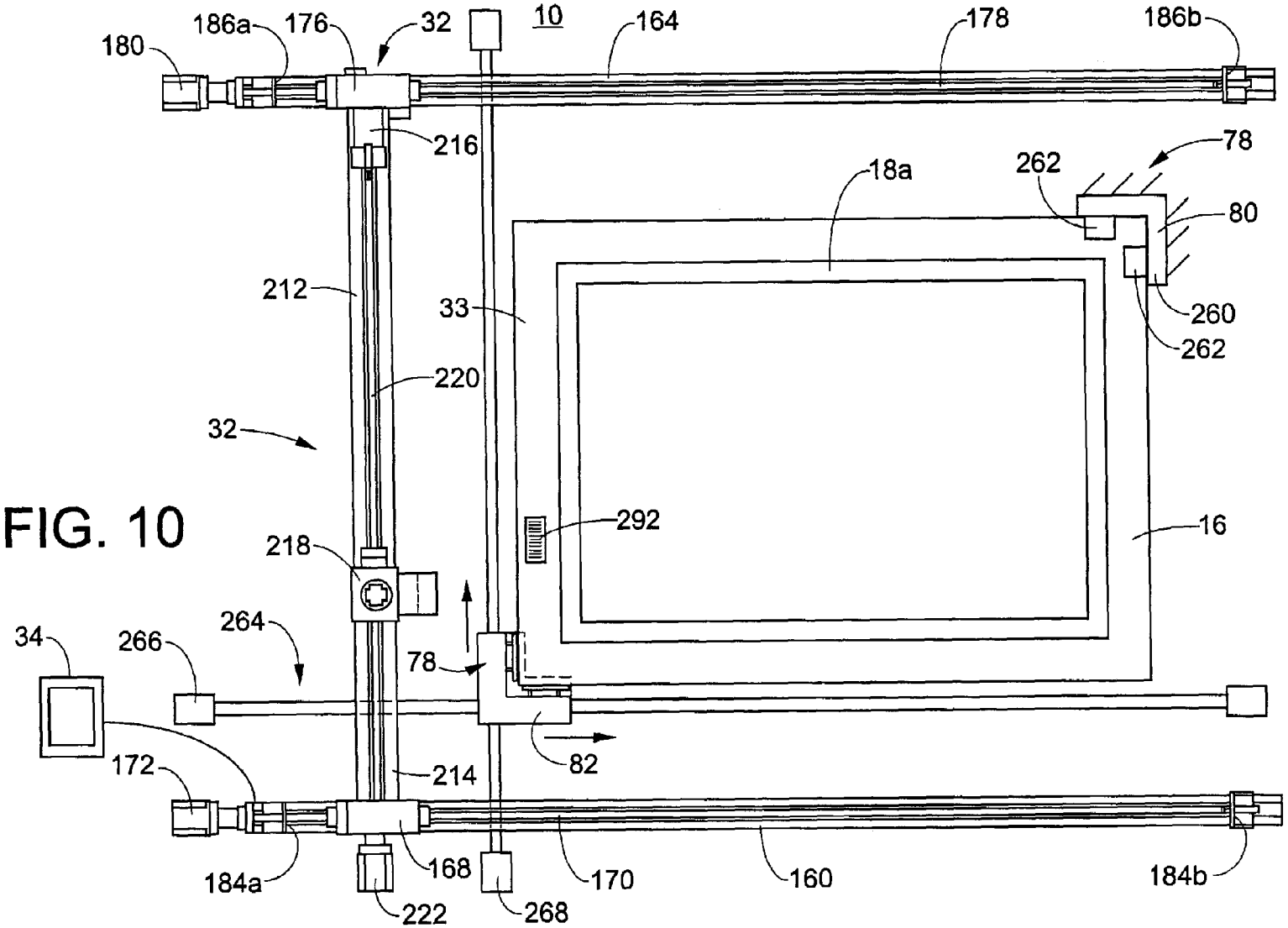
FIG. 10 is a plan view of a drive for moving an adhesive dispensing assembly with respect to a window sash that is secured by a sash support.

Referring to FIGS. 2 and 10–12, the adhesive metering and dispensing assembly 24 is positioned by the drive 32 with respect to a window sash 16 held in place by one or more supports 78. The illustrated supports hold the window sash 16 in a horizontal orientation. However, it should be readily apparent to one having ordinary skill in the art that the sash 16 can be supported in a vertical orientation and the dispensing assembly could be moved by a drive in a vertical plane. Referring to FIG. 10, in the illustrated embodiment the system 10 includes one fixed support 80 and one movable support 82. The movable support 82 allows various window sashes having various sizes and shapes to be positioned with respect to the drive 32.

Figure 21:
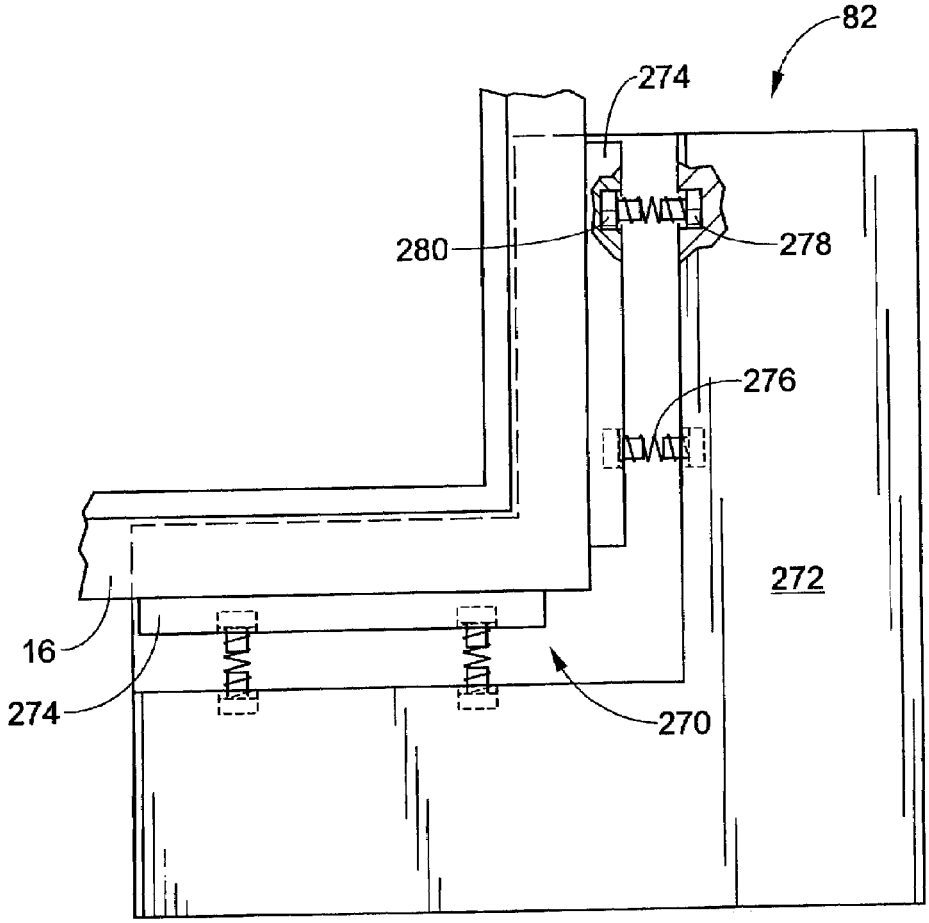
FIG. 21 is an illustration of a clamp for holding a sash member.

Referring to FIG. 10, the fixed support 80 includes a squaring member 260 and clamps 262. The squaring member 260 squares the sash 16 with respect to the drive 32 by engaging a corner of the sash. The clamps 262 clamp onto the sash to secure the sash in the "squared" position. Referring to FIG. 21, the illustrated moveable support 82 includes a spring loaded clamp assembly 270 coupled to a base 272. The spring loaded clamp assembly illustrated in FIG. 21 includes elongated members 274 and springs 276. The springs 276 couple the elongated members 274 to the base 272. In the illustrated embodiment, ends 278 are captured in recesses 280 in the base and recesses 282 in the elongated members. The elongated members are shown as separate elements, but could be joined to form a corner.

In use, the moveable support is moved to a position where the distance between the squaring member 260 and the spring loaded clamp assembly 270 is slightly greater than the distance between the corners of the sash 16. A sash is placed on the moveable support and the fixed support. The moveable support is moved toward the fixed support, such that the spring loaded clamp assembly engages one corner of the sash and the squaring member engages an opposite corner of the sash. The moveable support is moved to a position such that the springs 276 are slightly compressed, clamping the sash in place. The clamps 262 of the fixed support secure the position of the sash.

While the illustrated spring loaded clamp assembly includes elongated members and springs, it should be apparent that other clamping configurations could be employed. For example, the spring loaded clamp assembly could also comprise a plurality of spring loaded rollers.

In the illustrated embodiment, the position of the moveable support 82 is adjusted with an automatic positioning mechanism 264. The positioning mechanism 264 includes first and second drives 266, 268 that move the support 82 with respect to the X and Y axis of the drive 32. The illustrated drives 266, 268 are belt drives. It should be readily apparent that other types of drives, such as screw drives could be used to position the movable support or that the movable support could be manually adjusted. The positioning mechanism 264 is illustrated schematically by arrows in FIG. 2 and as dashed lines in FIGS. 11 and 12.

In an alternate embodiment, the system includes a table for supporting the sash 16, such as the table shown and described in U.S. patent application Ser. No. 10/032,850, now U.S. Pat. No. 6,868,884 (the '884 patent") entitled "Method and Apparatus For Applying Optical Film To Glass," assigned to GED Integrated Solutions, Inc. The '884 patent is incorporated herein by reference in its entirety. The table includes a top supported by a plurality of legs. A plurality of slots are included in the table top. A series of conveyors are disposed in the slots in the table. The conveyors are driven by an AC motor. The conveyors move a window sash placed at a first end of the table toward a second end of the table. In one embodiment, the window sash need not be aligned on the table top.

The illustrated drive 32 is a gantry. However, it should be readily apparent that the drive can be any mechanism that positions and moves the dispensing assembly with respect to the window sash. For example, the drive may be an articulated robotic arm. In the illustrated embodiment, the drive 32 is positioned around the support 78. The illustrated drive 32 includes a first rail 160 and a second rail 164. A first carriage 168 is slidably mounted to the first rail 160. A first ball screw 170 (shown in FIG. 2) is mounted within the first rail 160. The first ball screw 170 is coupled to the first carriage 168. A servo motor 172 is mounted to a first end of the first rail 160. The servo motor 172 is coupled to the first ball screw 170. Actuation of the first servo motor 172 causes rotation of the first ball screw 170 which moves the first carriage 168 along the first rail 160. The rail 160, ball screw 170 and carriage 168 maybe purchased as a unit. For example, Star Linear's # MKK25-110 ball screw actuator includes a rail, ball screw and carriage base that may be used in accordance with the present invention. One acceptable first motor 172 is Yaskawa's model number SGMGH-09.

A second carriage 176 is slidably mounted to the second rail 164 of the drive 32. A second ball screw 178 (illustrated in FIG. 2) is mounted within the second rail 164. A second servo motor 180 is mounted to a first end of the second rail. The second ball screw is coupled to the servo motor 180. Actuation of the servo motor 180 causes rotation of the second ball screw 178 which moves the second carriage 176 along the second rail 164 of the gantry 42. The first and second servo motors 172, 180 are connected to the controller 34, which controls actuation of the motors 172, 180 to move the carriages 168, 176 along the gantry 42 rails 160, 164. In the exemplary embodiment, the actuation of the motors 172, 180 is synchronized to move the carriages 168, 172 along the rails 160, 164 in unison. The rail 164, ball screw 178 and carriage 176 may be purchased as a unit. For example, Star Linear's # MKK25-110 ball screw actuator includes a rail, ball screw and carriage base that may be used in accordance with the present invention. One acceptable second motor 180 is Yaskawa's model number SGMGH-09.

The first rail 160 includes first and second stops 184*a*, 184*b*. The first and second stops 184*a*, 184*b* are mounted near ends of the first rail 160 to prevent the first carriage from moving off the first rail. Similarly, stops 186*a*, 186*b* are mounted to the second rail 164 to prevent the second carriage 176 from moving off the second rail.

Figure 11:
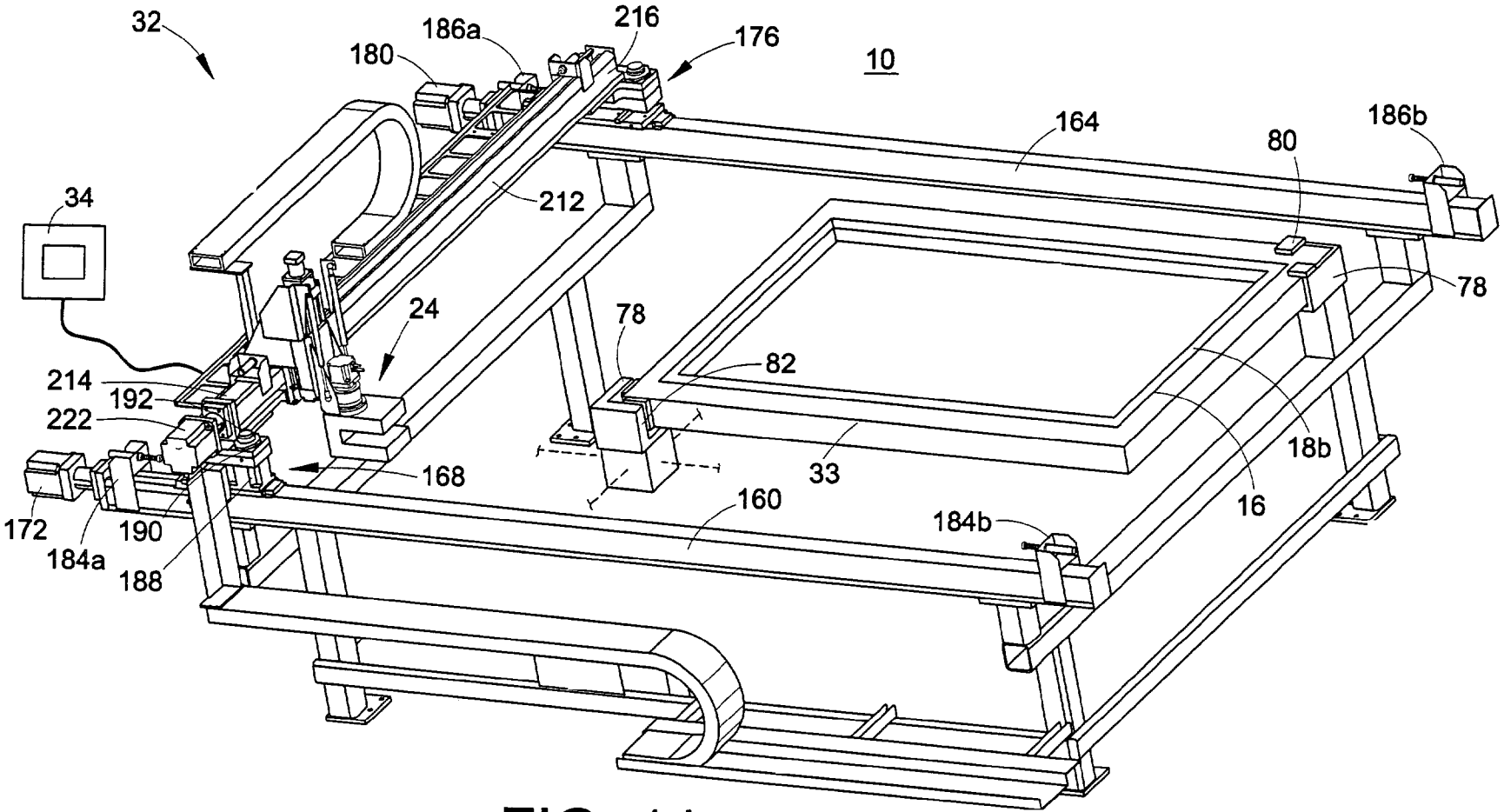
FIG. 11 is a perspective view of a drive for moving an adhesive dispensing assembly with respect to a window sash.
Figure 12:
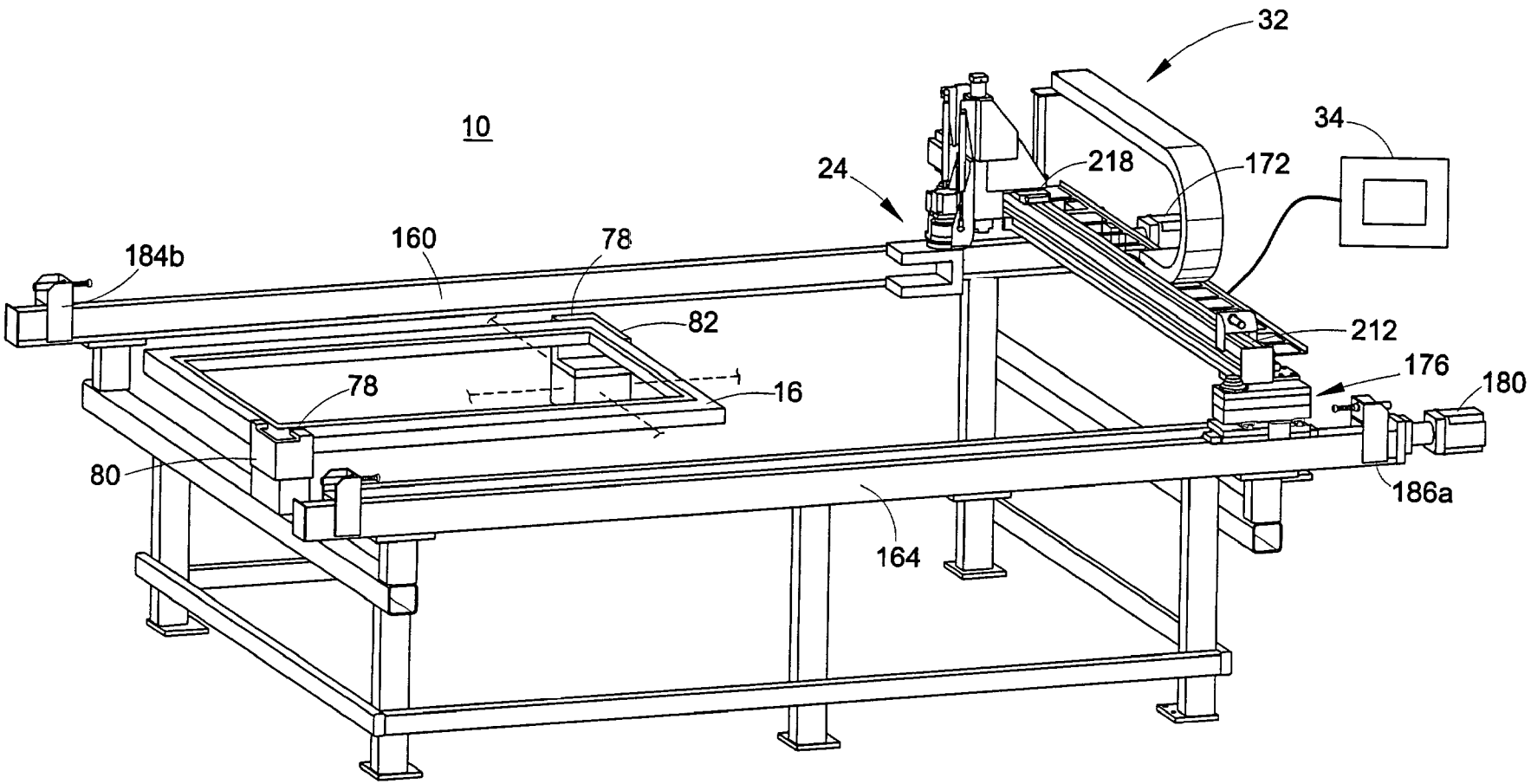
FIG. 12 is a perspective view of a drive for moving an adhesive dispensing assembly with respect to a window sash.

Referring to FIG. 11, the first carriage 168 includes a base 188 and a top plate 190. The base 188 is slidably mounted to the first rail 160 and is coupled to the first ball screw 170. The top plate 190 is connected t the base 188 by a pivotable connection 192 that allows the top plate 190 to rotate about the pivotable connection 192 with respect to the base 188.

Figure 14:
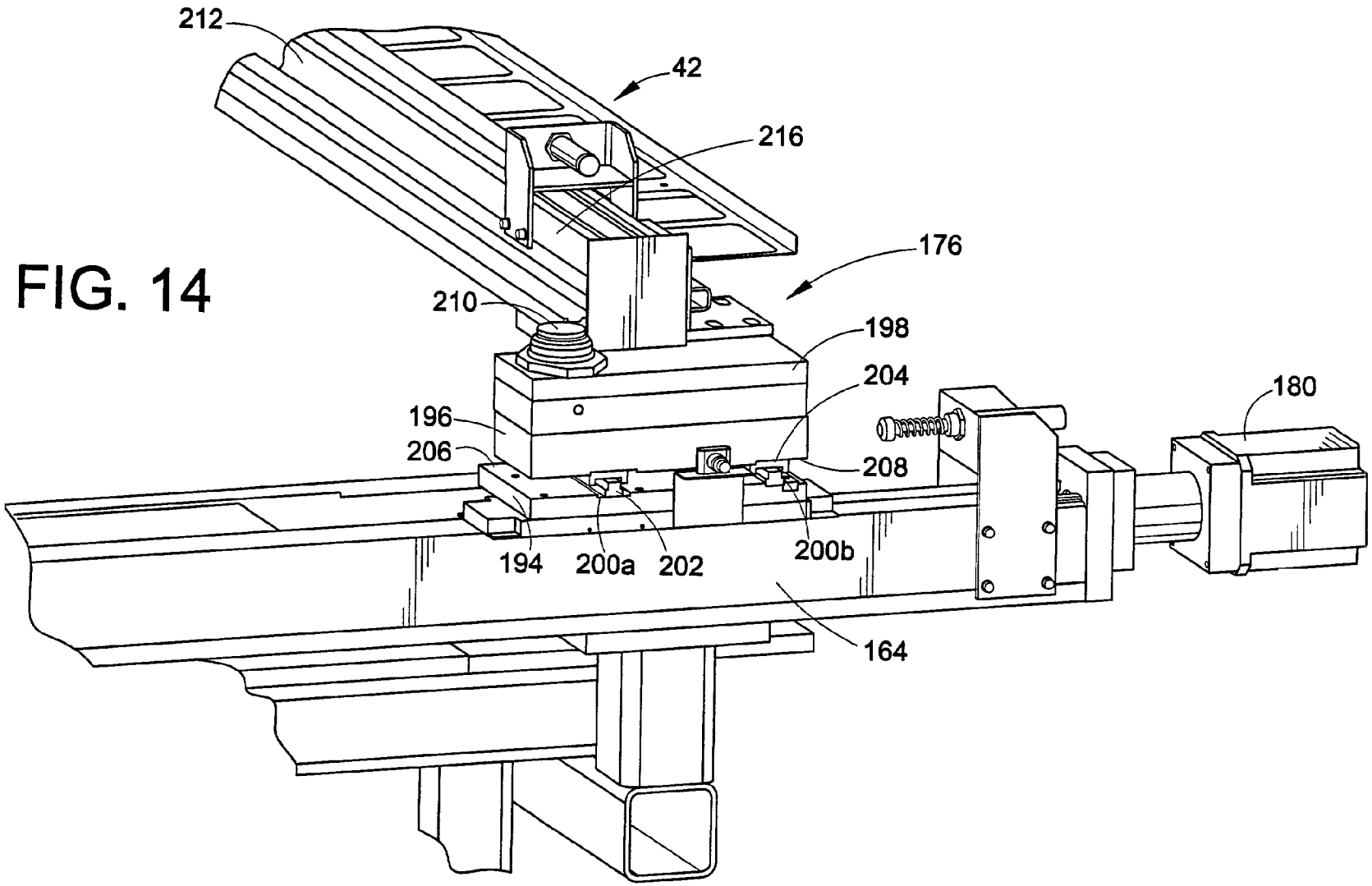
FIG. 14 is a partial perspective view showing a connection of an end of a rail of a gantry to a carriage of a gantry that supports the adhesive dispensing assembly.

Referring to FIG. 14, the second carriage 176 includes a base 194 an intermediate plate 196 and a top plate 198. The base 194 is slidably connected to the second rail 164 and is coupled to the second servo motor 180 by the second ball screw. First and second linear bearings 200*a*, 200*b* each include a rail portion 202 and a channel portion 204 slidably connected to the rail portion. In the embodiment illustrated by FIG. 14, the rail portion 202 of each linear bearing 200*a*, 200*b* is connected to a top surface 206 of the base 194 of the second carriage. The channel portion 204 of each linear bearing 200*a*, 200*b* is connected to a bottom surface 208 of the intermediate plate to slidably connect the intermediate plate 196 to the base 194. The intermediate plate is free to move transversely with respect to the base 194. The top plate 198 is connected to the intermediate plate 196 by a pivotable connection 210 that allows the top plate to rotate with respect to the intermediate plate 196.

The drive 32 includes a third rail 212 that extends between the first and second carriages. The third rail 212 includes a first end 214 that is fixed to the top plate 190 of the first carriage and a second end 216 that is fixed to the top plate 198 of the second carriage. The dispensing assembly 24 is slidably connected to the third rail 212. A third ball screw 220 (shown in FIG. 10) is rotatably mounted within the third rail 212. A third servo motor 222 is mounted to a first end of the third rail 212. The third servo motor 222 is coupled to the third ball screw 220. Actuation of the third servo motor 222 causes rotation of the third ball screw 220 which moves the dispenser carriage 218 along the third rail 212. The rail 212, ball screw 220 and carriage 218 may be purchased as a unit. For example, Star Linear's # MKK25-110 ball screw actuator includes a rail, ball screw and carriage base that may be used in accordance with the present invention. One acceptable third motor 222 is Yaskawa's model number SGMGH-09.

In the illustrated embodiment, the first and second carriages 168, 176 of the drive 32 are moved independently by servo motors 172, 180. In the event that one of the first and second carriages 168, 176 binds up on one of the side rails 160, 164 of the gantry 42, the third rail 212 pivots with the top plates 190, 198 of the first and second carriages 168, 176 to prevent damage to the drive 32. When one end of the gantry 42 stops as a result of the binding and the second end of the gantry 42 continues to move along the rail, the third rail 212 and top plate 190 of the first carriage 168 rotate with respect to the base of the first carriage 168. The third rail 212 and the top plate 198 of the second carriage 176 rotate with respect to the base 194 of the second carriage 176. In addition, the intermediate plate 196, top plate 198 and end 216 of the third rail 212 move along the linear bearings 200*a*, 200*b* toward the first rail The pivotal connection between the first rail and the third rail 212 and the pivotal and slidable connection between the second rail and the second end of the third rail 212 allows the third rail 212 of the gantry to rotate if one of the carriages 168, 176 of the gantry 42 binds up, preventing damage to the gantry 42.

Figure 15:
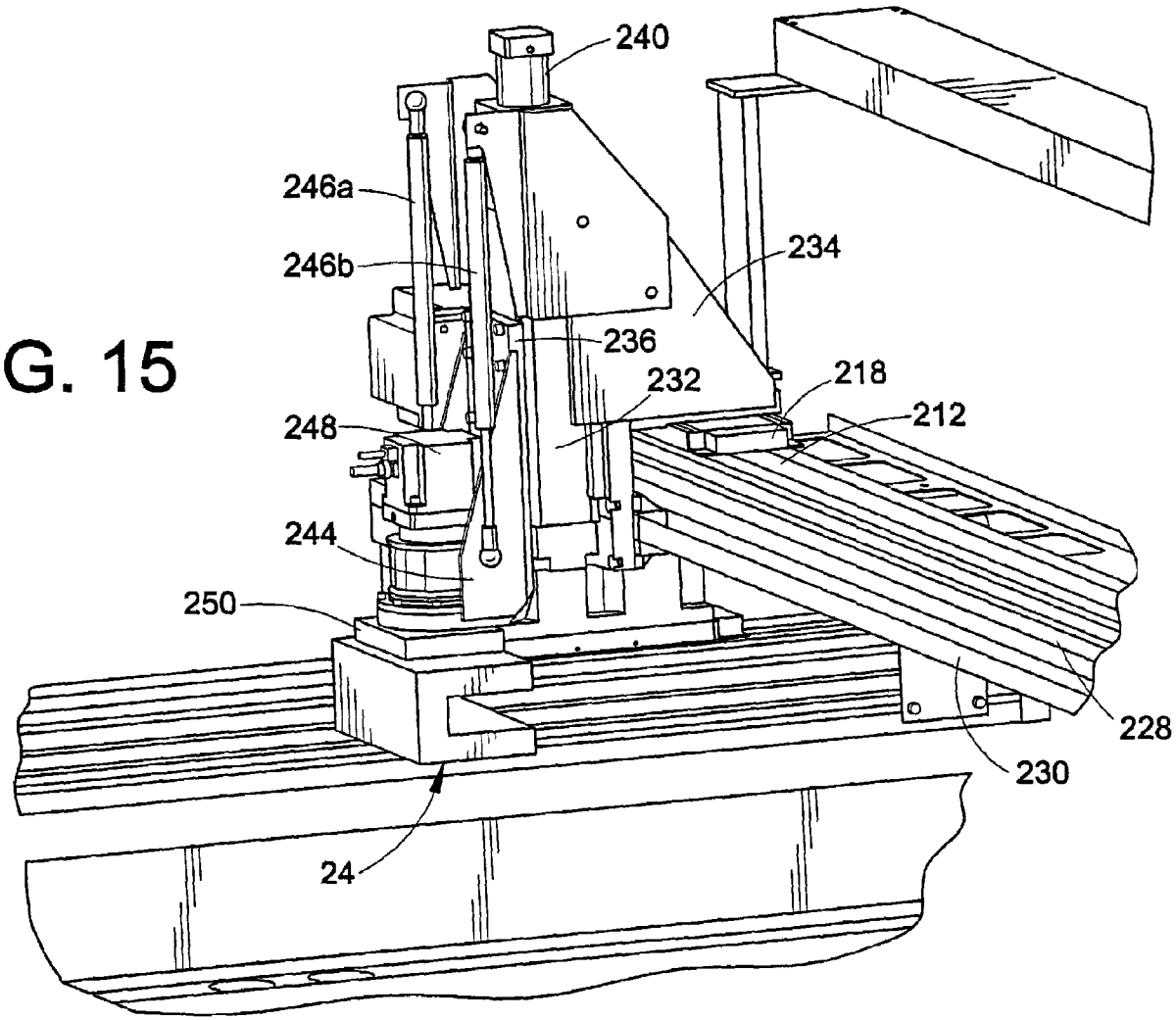
FIG. 15 is a perspective view of a dispensing assembly mounted to a drive that positions the dispensing assembly.

In the illustrated embodiment, the dispenser carriage 218 is slidably mounted to the third rail 212. Referring to FIG. 15, vertical rail 232 is connected to the dispenser carriage 218 by brackets 234. The vertical rail 232 is slidably connected to a guide 230. The vertical rail 232 and dispenser carriage 218 slide as a unit along the third rail 212 when the third ball screw 220 is driven by the third servo motor 222. The guide 230 stabilizes the vertical rail 32 and dispenser carriage 218 on the third rail 212.

Referring to FIG. 15, a vertical carriage 236 is slidably mounted to the vertical rail 232 in the illustrated embodiment that facilitates vertical adjustment of the dispensing assembly. In an alternate embodiment, the dispensing assembly 24 is not vertically adjustable with respect to the third rail. In this embodiment, the height of the supports 78 may be adjustable. In the illustrated embodiment, a vertical ball screw extends within the vertical rail 232. A vertical motor 240 is mounted to the top of the vertical rail 232. The vertical motor 240 is coupled to the vertical ball screw. Actuation of the vertical motor 240 causes rotation of the vertical ball screw which moves the vertical carriage 236 along the vertical rail 232. The vertical rail 232, vertical ball screw and vertical carriage 236 may be purchased as a unit. For example, Star Linear's # CKK-20-145 ball screw actuator includes a rail, ball screw and carriage base that may be used in accordance with the present invention. One acceptable motor 172 is Yaskawa's model number SGMAH-01.

Referring to FIG. 15, the vertical carriage 236 includes an L bracket 244. First and second gas springs 246*a*, 246*b* are connected at one end to the L bracket 244 and at one end and to brackets 234 connected to the vertical rail 232. The gas springs 246*a*, 246*b* provide an upward force on the dispensing assembly 24 to counterbalance the weight of the dispensing assembly. The gas springs 246*a*, 246*b* reduce the amount of load carried by the vertical motor 240. The vertical motor pushes the dispenser 40 down against the force supplied by the gas springs 246*a*;246*b* and pulls the dispenser 40 up with the assistance with the gas springs 246*a*, 246*b*. The gas springs 246*a*, 246*b* prevent the dispenser 40 from descending when power to the vertical motor 240 is lost.

A rotary motor 248 is connected to the L bracket 244 of the vertical carriage 236. The rotary motor 248 is selectively actuated by the controller 34. The rotary motor 248 is coupled to a mounting plate 250 that carries the sealant dispenser 24. The controller 44 provides signals to the rotary motor 248 that cause the rotary motor to rotate the gear pump of the dispenser 24. One acceptable rotary motor is Yaskawa's model number SGMPH-02.

In one embodiment, the system includes an optical sensor 252 (FIG. 1) that is connected to the dispensing assembly 24. The optical sensor senses edges of the window sash and provides an output to the controller 34. The output of the optical sensor is used to detect the location and orientation of the window sash. One acceptable optical sensor 252 is a Keyence #FU-38 sensor. The size and position of the window sash 16 may alternatively be manually entered into the controller or may be determined by the position of one or more supports. The method of automatically detecting the position and orientation of a glass sheet disclosed in the '850 application may be used to detect the position and orientation of the window sash 16 when the system 10 includes an optical sensor that is moved by the drive. In an alternate embodiment, a bar code reader 290 is coupled to the controller 34. The bar code reader 290 reads a bar code 292 no the sash that indicates the size, shape and type of sash being processed. The controller 34 may use this bar code information to position the supports and determine the path of the dispensing assembly 24.

Controller Operation

Figure 13:
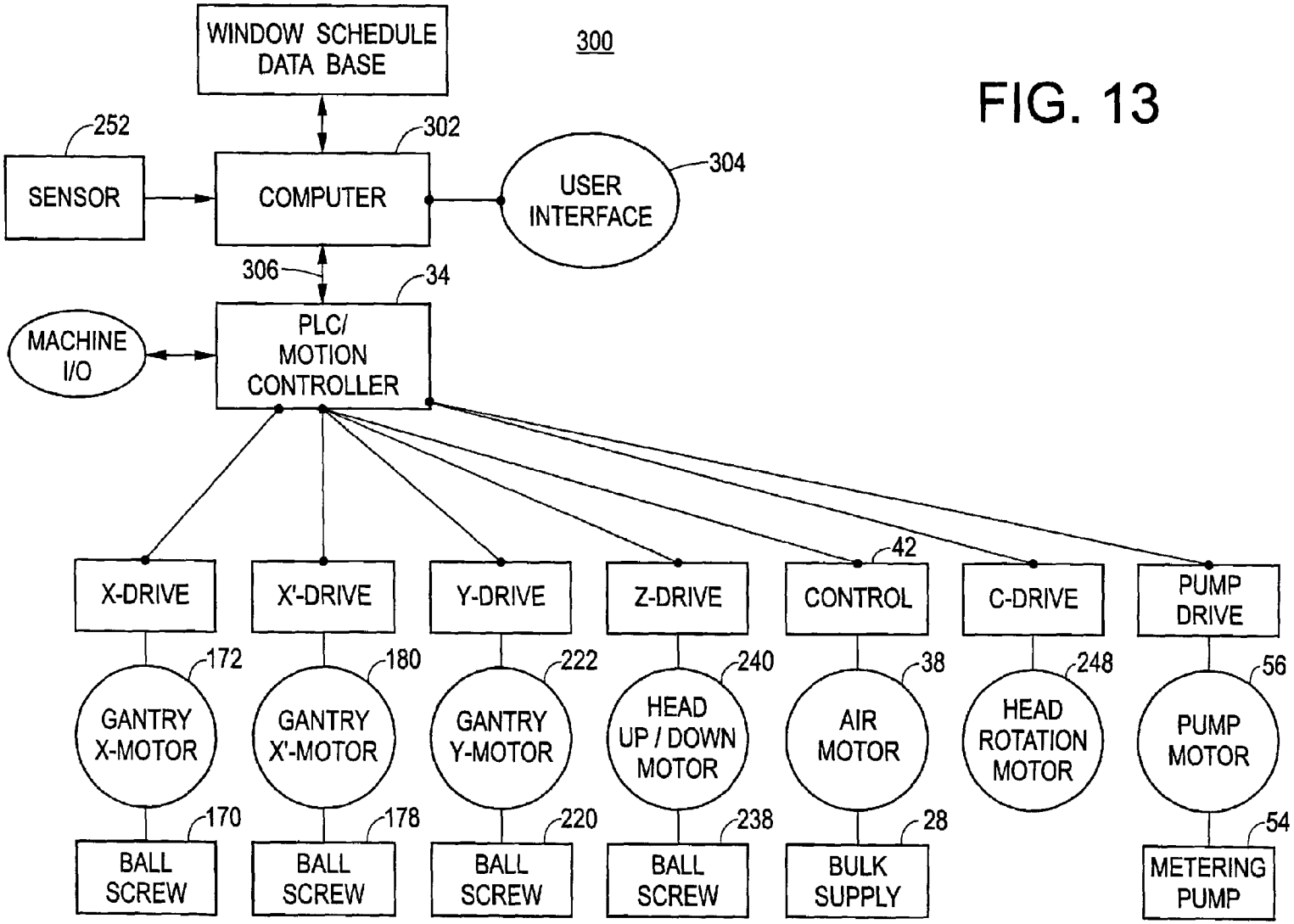
FIG. 13 is an overview of a schematic of a control system for a system for applying adhesive to a window sash.

FIG. 13 illustrates a schematic of a control system 300 for controlling a number of motors included in the system for controlled dispensing of adhesive. A computer 302 is coupled to a network (not shown) and is most preferably a specially programmed personal computer running an operating system compatible with network communications. The computer 302 receives a window schedule indicating sizes that determine adhesive and/or sealant application paths for adhesive or sealant to be applied to multiple window sashes 16. These sashes may all be of a particular size or they may be the sashes for a particular job, order or customer. The schedule is generated by a separate computer that is coupled to the computer 302 depicted in FIG. 13 by means of a network interface. A user interface 304 for the computer in FIG. 13 constitutes a touch panel screen and keyboard which allows an operator of the adhesive dispensing system 10 to control operations of the system.

A two way serial communications link 306 exists between the computer of FIG. 13 and a motion controller 34 specially programmed for coordinated energization of a number of motors and receipt of a number of input signals derived from various sensors located within the adhesive application system. One acceptable controller is a Delta Tau UMAC motion controller. The computer 302 transmits control signals to the motion controller 34 for each sash that adhesive is to be applied to by the dispensing system. Thus, the computer receives a schedule from a remotely located computer, evaluates that schedule, and sends a set of controls to the motion controller for each sash until adhesive has been applied to all sashes in the schedule.

In one embodiment, one input to the computer 302 is provided by the bar code reader 290. The bar code reader is used to scan a bar code 292 on a sash. The bar code includes information about the sash, such as the size and shape of the sash, which is provided to the computer. This information is used by the motion controller for applying material to the scanned sash.

The motion controller 34 interfaces with a number of motor drives for different motors used in the system. These motors position the adhesive dispensing assembly 24 with respect to the window sash 16. The motors also control various actions performed by the dispensing assembly 24 as the dispensing assembly 24 moves with respect to the sash. Three direct current servo motors 172, 180, 222 coupled to the drive 32 control the position of the dispensing assembly 24 in an x-y plane defined by the window sash. Two motors designated gantry motor 172 and gantry motor 180 are energized by the controller in a coordinated fashion with each other to move the drive 32 back and forth. A third motor designated gantry motor 222 moves the dispenser 24 across the horizontal support 212. These motors are servo motors activated with a direct current signal in either of two directions. Coordinated energization of these motors positions the dispensing assembly 24 during adhesive dispensing as well as positions the dispensing assembly prior to application of adhesive or sealant to the sash.

In one embodiment sash orientation is sensed. These motors 172, 180, 222 also drive the dispensing assembly 24 relative to the sash so that an optical sensor mounted to the dispenser can determine the sash orientation. The optical sensor communicates signals by means of an input to the motion controller. Additional inputs that are used by the motion controller are discussed below.

In one embodiment, an additional motor 240 moves the dispensing assembly up and down to adjust the alignment of the dispensing assembly with respect to the window sash. This vertical adjustment also allows the dispensing assembly to be moved from outside the perimeter of the window: sash to inside the perimeter of the window sash and visa versa. This motor 240 is also a direct current servo motor.

In the exemplary embodiment, the dispensing assembly 24 is also mounted for rotation about a vertical axis through a range of 360° or more. The angular orientation of the dispensing assembly 24 is controlled by a head rotation motor 248 which also constitutes a direct current servo motor which can be driven in either direction.

The controller 34 is coupled to a control regulator 42 that controls an air motor 38. The air motor 38 supplies adhesive or sealant 12 from the bulk supply 28 to the metering gear pump 54. In the exemplary embodiment, an inlet pressure sensor 62 and/or an outlet pressure sensor 64 are coupled to the controller 34. The controller 34 causes the air motor 38 to supply additional adhesive under pressure to the metering pump 54 when the pressure of the adhesive drops.

Figure 9:
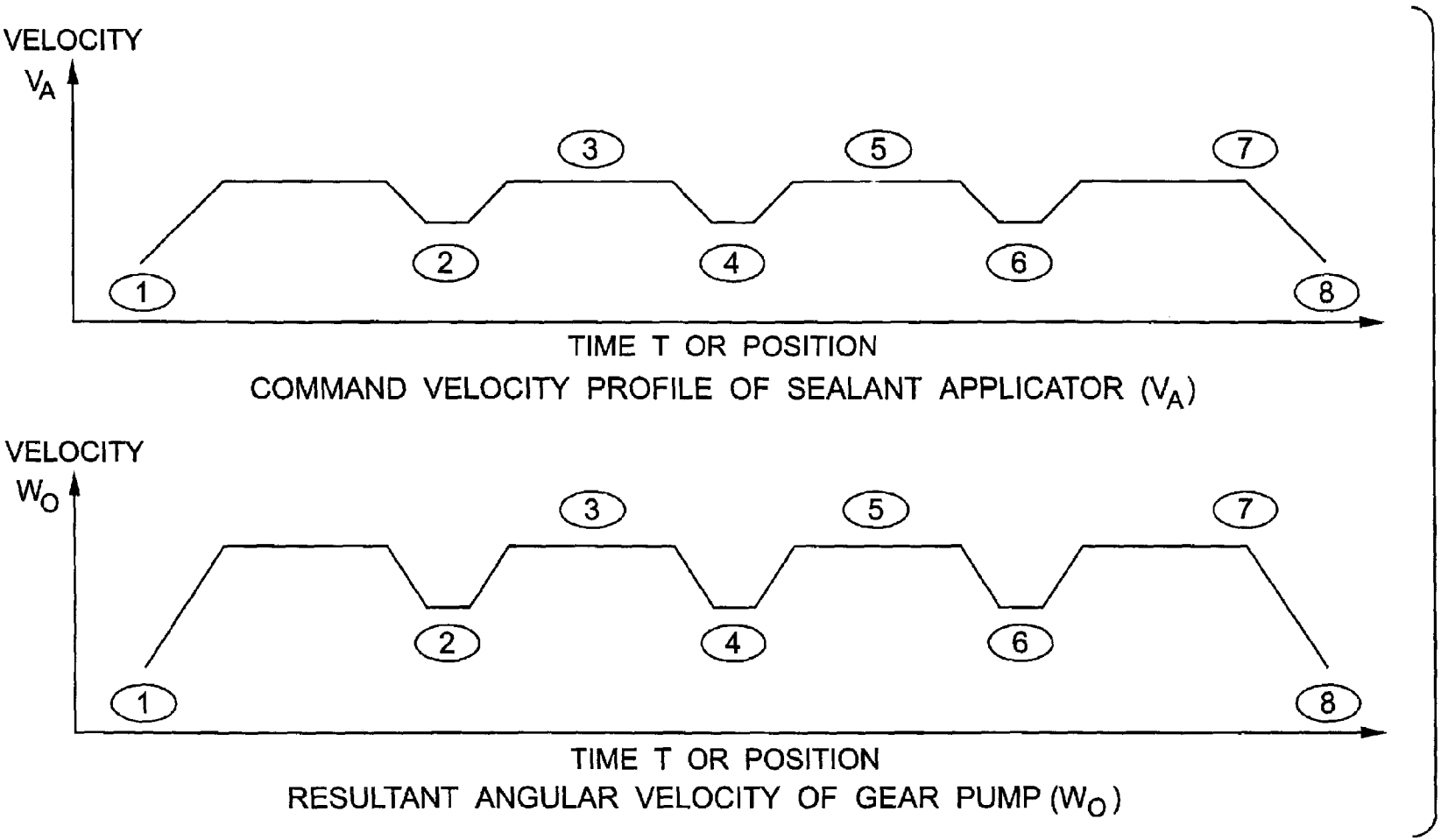
FIG. 9 is a timing diagram showing control of the dispensing of desiccant and adhesive by a programmable logic motion controller.

The gear pump motor 56 rotates gears of the pump 54 to dispense adhesive or sealant 12 onto a window sash 16. In the exemplary embodiment, the speed that the drive 32 moves the dispensing assembly 24 around the dispensing path P of the window sash 16 is continuously calculated by the computer 302. Referring to FIG. 9, the computer 302 continuously determines the appropriate speed $w_o$ of the gear pump motor 56 based on the speed $V_a$ the dispensing assembly 24 is moving and the volume per unit length of adhesive that is to be applied around the perimeter of the window sash 16. For example, referring to FIGS. 2 and 9, the dispensing assembly 24 might start at a corner 1 of the window sash 16 at the time T1. The dispensing assembly 24 may be initially stationary at corner 1 and time T1 and the gear motor 56 is stopped. As the dispensing assembly begins to move toward corner 2, the motor 56 begins to drive the gear pump to dispense adhesive. As the dispensing assembly increases in speed $V_a$, the speed $w_o$ of the gear pump motor 56 increases to dispense a uniform bead of adhesive or sealant to the window sash 16. The dispensing assembly 24 and gear pump motor 56 slow down as corner 2 is approached. The dispensing assembly 24 turns to follow the path P around the corner. The computer 302 calculates the speed $V_a$ of the dispensing assembly 24 around corner 2 to control the speed $w_o$ of the gear pump. The dispensing assembly continues around the path P past points 3, 4, 5, 6, 7 and 8 in this manner and the speed $w_o$ of the gear pump is controlled to dispense a uniform bead of sealant and/or adhesive around the perimeter of the window sash 16.

Referring to FIG. 1, the controller 34 in the exemplary embodiment is in communication with a computer 30 coupled to an interface, such as a touch sensitive display 135 for both inputting parameters and displaying information. In one embodiment, the computer saves application data and setups for different window lines. The controller 34 controls the motion of the drive 32, the pressure supplied by the adhesive bulk supply 28, the speed at which the motor 56 turns the adhesive gear pump 54, and the time at which the adhesive guns 58*a*, 58*b*, as well as other parameters. The user of the controlled adhesive dispensing system 10 inputs several parameters via the touch screen 135 to the controller 34. These inputs may include the size and type of window sash, the target pressure of desiccant supplied by the desiccant bulk supply, the target pressure of adhesive supplied by the adhesive bulk supply 28, the thicknesses of the adhesive 12 applied to the glass abutting walls 18*a*, 18*b*, a gear pump on delay, a gear pump off delay, a gear pump motor acceleration time, and a gear pump motor deceleration time.

By supplying adhesive 12 to the gear pumps 54 at an appropriate pressure (typically between 600 psi and 1500 psi) and controlling the speed at which the motors drive the gears of the gear pumps, the volumetric flow rate of adhesive(s) 12 are accurately controlled. The required volumetric flow of adhesive 12 is calculated by multiplying a cross-sectional area of adhesive 12 applied to the glass abutting walls 18*a*, 18*b* by the speed at which the drive 32 is moving the sash. In the exemplary embodiment, the cross-sectional area of the applied adhesive 12 is equal to 2 times width W of the glass abutting surfaces multiplied by the thickness $T_1$ of adhesive to be applied. The speed at which the adhesive motor 56 must drive the gears of the adhesive gear pump 54 in revolutions per second is equal to the calculated required volumetric flow divided by the volume of adhesive provided by the gear pump per revolution of the gear pump.

For example, the cross-sectional area of adhesive applied to both glass abutting walls of a window sash 16 glass with widths of 1 cm, requiring 0.2 cm adhesive thickness is 0.4 $cm^2$. At an instant in time when the drive is moving at 100 cm per second, the required volumetric flow rate provided by the adhesive pump to nozzles would be 40 $cm^3$ per second (the cross-sectional area 0.4 $cm^2$ times the velocity of the drive 32 100 cm per second). If the flow created by the pump per revolution is 20 $cm^3$ per revolution, the required pump speed would be two revolutions per second or the required volumetric flow divided by the flow provided by the pump per revolution.

There is a short distance (approximately 3") between the adhesive gear pump 54 and the adhesive dispensing guns 58*a*, 55*b*, in the exemplary embodiment. A pump on delay field input to the controller 34 is a time delay from when dispensing begins to when rotation of the gear pumps by the motors begins. In the exemplary embodiment, the pump on delay is a negative number (approximately −0.06 seconds) thereby beginning rotation of the gear pumps before the dispensing nozzles are opened. This causes material to flow through the nozzles as soon as the nozzles are opened.

A pump off delay is the time delay between the time when the dispensing nozzles 74 are closed and rotation of the gear pumps by the motor is stopped. In the exemplary embodiment, this number is also a negative number, indicating that the rotation of the gear pumps stops before the nozzles 74 are closed. In the exemplary embodiment, this delay is −0.04 seconds. By stopping the rotation of the gear pumps 54 before the nozzles are closed, excessive pressure at the nozzle is avoided.

In the exemplary embodiment, the motor acceleration and deceleration parameters are input to the controller 34 through the touch screen 135. Motor acceleration is the time required to reach the desired motor speeds. The motor deceleration parameter is inputted to the controller 34 through the touch screen 135. Motor deceleration is the time required to reduce the speed of the gear pump gears to a desired speed or stop the gear pump gears. In the exemplary embodiment, the motor acceleration and motor deceleration times are minimized to provide a consistent bead of dispensed material.

System Operation

In operation, a window sash size and shape is selected and inputted into the computer. In the exemplary embodiment, the user of the system enters a user code to the controller 34 via the touch screen 135 which allows the user to configure the adhesive dispensing system 10. The user inputs the target pressure of adhesive 12 supplied by the bulk supply 28 through the hose 44, at the inlet of the gear pump 54. The user inputs a peak rate of speed of the drive, or allows the drive to move at a default peak speed. The user selects the thickness of adhesive that is applied to the glass abutting walls 18*a*, 18*b*. The gear pump on delay and gear pump off delay for each of the gear pumps may be entered by the user. The motor acceleration and deceleration times may also be entered to the controller 34 via the touch screen 136. The computer sends a series of signals to the motion controller by means of a bidirectional communication connection for processing the window sash 16. A window sash 16 is secured to the supports 78 in the illustrated embodiment. In one exemplary embodiment, the controller 34 provides signals to the servo motor 172, 180 and 222 to move an optical sensor over the window sash to identify or determine the exact location or size of the window sash 16. The illustrated sash is rectangular. In the exemplary embodiment, the system 10 is capable of applying material to sashes having any shape. For example, the system 10 may apply material to circular, semicircular, trapezoidal and any other shape of window sash. The controller 34 causes the drive 32 to position the dispensing assembly 24 with respect to the window sash 16. The controller 34 provides a signal to the motor 56 that causes the gear pump to begin dispensing adhesive 12. The controller 34 causes the drive 32 to move with respect to the window sash to dispense adhesive around the path P defined by the window sash 16.

Low Porosity Covering Material Application

Figure 16:
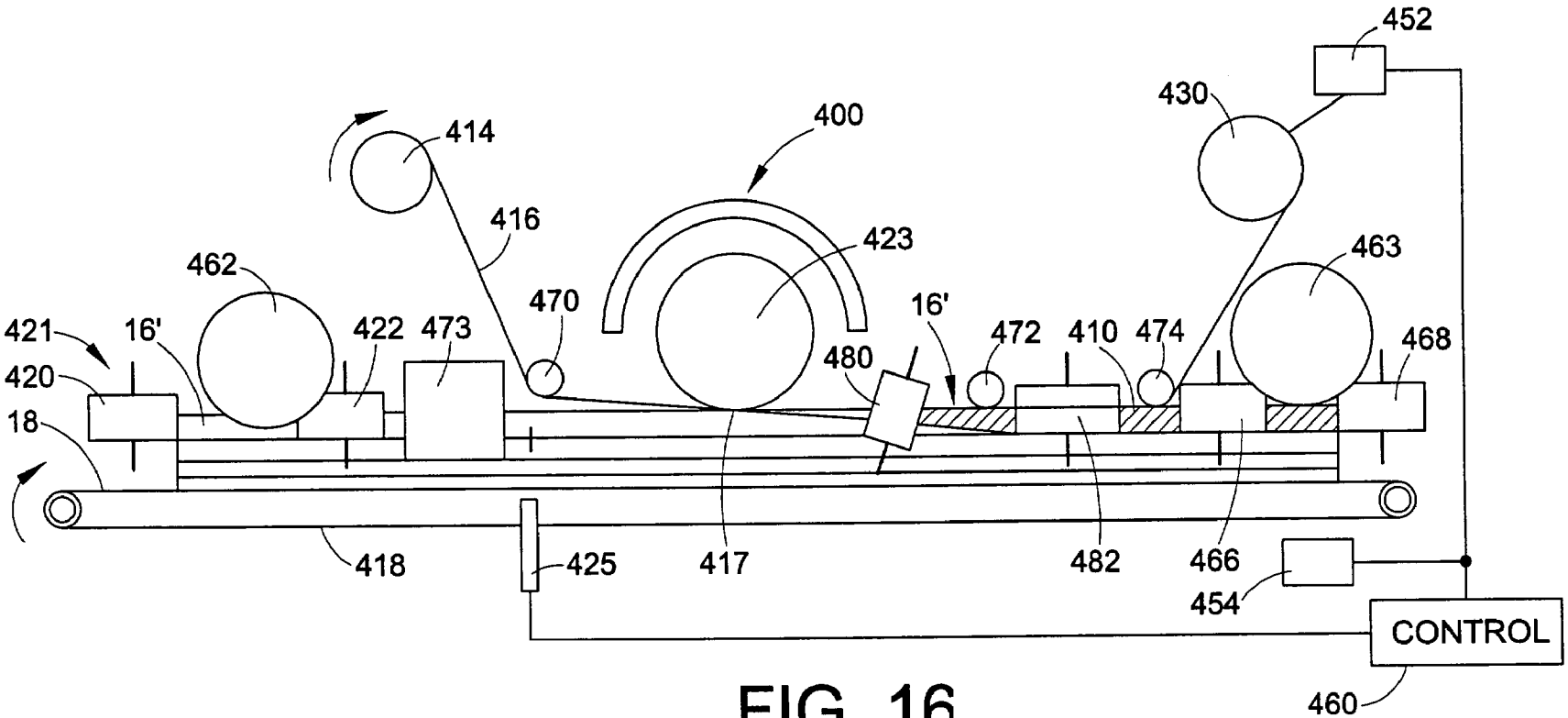
FIG. 16 is a schematic depiction of an apparatus for applying covering material to sash members.

FIG. 16 illustrates a station 400 for applying a covering material 410, such as a film or coating, to an elongated window sash member 16'. The covering material 410 serves as a barrier to moisture that could otherwise enter the insulating glass unit. The elongated sash members 16' are assembled to form a sash 16. For example, sash members 16' may be mitered and welded together to form a rectangular sash 16. Apparatus depicted in FIG. 16 covers the innermost surface 23 and most or all of the glass, abutting surfaces 18*a*, 18*b* with the covering material 410. A supply 414 that is mounted for rotation unwinds an elongated strip 416 including a covering material 410 from the supply 414. The elongated strip 416 is routed to a region 417 of contact between the sash 16 and the strip 416. In the disclosed embodiment the covering material 410 is applied to the innermost surface 23 and the glass abutting surfaces 18*a*, 18*b* as the sash moves along a travel path defined by a conveyor 418.

Returning to FIG. 16, the elongated strip 416 is brought into contact with the surface 23 of the sash member 16' as the conveyor 418 moves the sash member 16' along a generally linear travel path. In one embodiment of the invention, an operator places a sash member 16' onto a top surface of the conveyor 118 between two guide rollers 420 that form an entrance 421. The conveyor 418 moves the sash member 16' through a second set of guide rollers 422 which in combination with the first set of rollers maintain side to side registration of the sash member 16'. The sash member 16' contacts the strip 416 downstream from the rollers 422.

The strip 416 includes a film or covering material 410 that is applied onto a desired portion of the sash member 16', i.e., innermost surface 23 of the sash member 16'. Application of the covering material 410 onto a desired portion of the sash is accomplished using controlled application of heat and pressure by the roller 423 against the sash member 16' and the strip 416. The heat and pressure applied by the roller causes the covering material or film 410 to separate from the elongated strip 416 and adhere to the sash member's surface 23.

Figure 19:
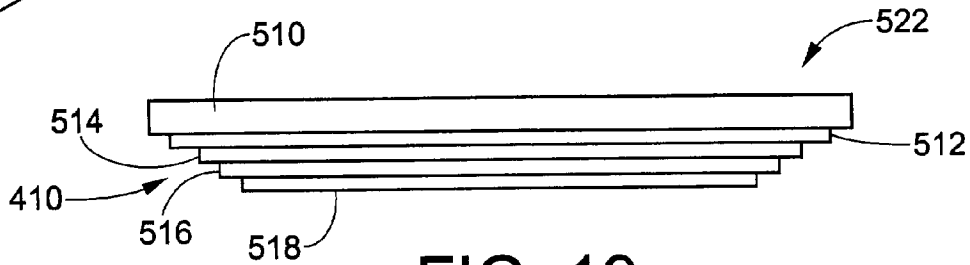
FIG. 19 is a schematic depiction of a laminated foil used in applying a film or coating to a sash member.

Turning to FIG. 19, the elongated strip 416, sometimes referred to as a hot stamp lamination foil, comprises a carrier layer 510, typically a polyester film, which provides a backing or substrate for the strip 416. A release layer 512 is adhered to the carrier layer 510 and, in turn, the covering material 410 is adhered to the release layer 410. The release layer 512 preferably is a lacquered resin with a low melting point. During the lamination or application process, when the strip 416 is sufficiently heated the release layer 512 melts thereby releasing or separating the covering material 410 from the carrier layer 510. Pressure applied causes the covering material 410 to be adhesively affixed to the surface 23 of the sash 16.

In one exemplary embodiment, the covering material or film 410 is comprised of three layers: a decorative color layer 516, a low porosity layer 514 and an adhesive layer 518. The decorative layer is optional. The low porosity layer 514 prevents moisture from entering the multipane window unit through the porous material of the window sash.

When the decorative color layer 516 is used it matches the color of the sash 16. The decorative color layer 516 is typically an ink lacquer which dries very rapidly by release of solvent.

The adhesive layer 518 comprises an adhesive that is formulated for compatibility with the material the sash is made from. The adhesive layer 518 is typically comprised of a combination of resins (lacquers) that cure from applied heat and chemically cross link the low porosity layer (and the decorative layer if included) to the material the sash is made from.

Referring again to FIG. 16, movement of the sash members 16' and the strip 416 is coordinated by a drive system (discussed below) for simultaneously unwinding the strip 416 and actuating the conveyor 418 to bring the sash members and strip into contact with each other at the same speed. Once the covering material 416 separates from the strip 416 and adheres to an associated sash member 16', the carrier layer 510 is rewound onto a recoiler 430. In the disclosed exemplary embodiment of the invention, the covering material 410 covers surface 23 and most or all surfaces 18*a*, 18*b* of the sash members that are delivered to the transfer region by the conveyor.

Figure 18:
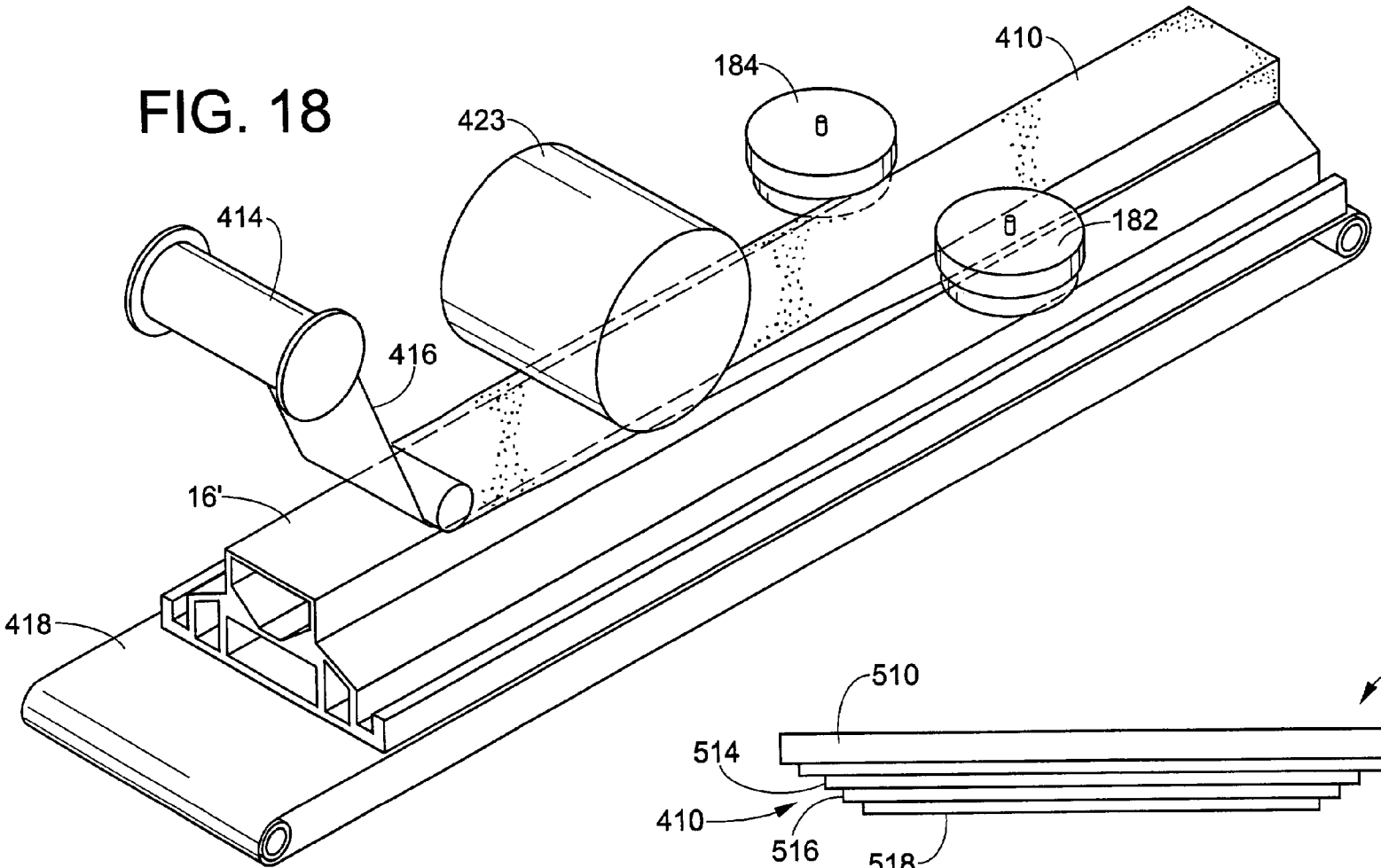
FIG. 18 is a perspective view of the apparatus of FIG. 16 with some components deleted for clarity of explanation.

Referring to FIGS. 16 and 18, the pressure roll 423 applies pressure to a region of engagement between the sash member 16' and the strip 116. In the exemplary, embodiment of the invention the pressure roll is mounted for up and down movement so that in a down position the roll 423 applies heat and pressure to a sash. A sensor 425 which, in the exemplary embodiment of the invention, is an optical sensor, senses when radiation emitted by the sensor 415 is reflected by the sash members 16' as they pass by the sensor 425. Each time the sensor 425 senses the arrival of a leading edge of a next subsequent sash section delivered by the conveyor 418, a controller 460 actuates a drive. (not shown) which moves the roll 423 to contact that sash section 16'.

The covering material 410 of the strip 416 is transferred onto the surface of the sash member 16' using heat and pressure. During the lamination process, the release layer. 512 is melted and the carrier layer 510 separates from the covering material layer 410 that adheres to the-sash member. This leaves the layers 514, 516, 518 that make up the covering layer 410 on the surfaces 23, 18*a*, 18*b*.

The recoiler 430 and the conveyor 418 are driven by respective motors 452, 454 having output shafts coupled to the recoiler and the conveyor whose speed of rotation is coordinated by the control 460 which, in an exemplary embodiment of the invention, is a programmable controller executing a stored program. The controller 460 coordinates the speed of rotation of the two motors 452, 454 to a desired speed setpoint. Two idle rollers 462, 463 are mounted above the sash members so that they contact a top surface of the sash members and help hold the sash members in position as the conveyor moves the sash members along a path of travel through a region where they are contacted by the heated pressure roll 423.

Side to side alignment or registration of the sash member 16' is maintained by the entrance guide rollers 420, 422 and pairs of exit guide rollers 466, 468 that engage the, side of the sash member 16' downstream from the; pressure roll 423. The guide rollers 420, 422, 466, 468 rotate about generally vertical axes and maintain the sash member in side to side V alignment in the region 417. The strip 416 comes into contact with the sash member 16' and is heat and pressure treated by the pressure roll 423. These guide rollers are idle rollers that rotate as the sash members 16' are conveyed along a travel path by the conveyor 418.

The strip 416 is unwound from its supply 414 and reeved around a guide roller 470. The strip 116 then contacts the sash member 16' at the region 417 of the pressure roll. The sash member 16 and pressure roll 423 define a nip which exerts a pressure against the strip 416. Proper application of heat and pressure causes the carrier layer and the covering material to separate from each other. On the exit side of the pressure roll 423, the carrier layer 510 passes under two guide wheels 472, 474 and is then would onto the recoiler 430.

In the exemplary embodiment, the pressure roll 423 is a heat controlled iron impregnated silicone roller. Before reaching the roller 423, the sash member 16' passes through a controlled preheat chamber 473 to preheat the sash 16. Preheating the sash member 16' facilitates proper adhesion of the adhesive layer 512 to the surface 23 of the sash member to produce high quality lamination at high speeds (greater than 10 feet per minute). The heating cross links bonding between the film or coating 410 and the sash member 16'.

Experience with the lamination process has identified ranges of operating parameters for use in practicing the invention. For example, when the covering material 410 is an aluminum strip, it has been found that the preheat chamber 472 should raise the temperature of the sash member 16' to approximately 200° F. at an exit from the chamber 472. Performance has been seen to be adequate when the temperature is within a range of 190° F. to 210° F. At the contact region 417 the temperature of the pressure roll 4123 has been adequate when maintained at about 400° F. Throughputs of between ten and fifty feet per minute and even higher throughputs may be achievable.

In accordance with the exemplary embodiment of the invention, the strip 416 has a width that completely cover the innermost surface 23 of the sash and hangs over the surfaces 18*a*, 18*b* a distance to cover the majority of surfaces 18*a*, 18*b*.

Referring to FIG. 16, downstream from the pressure roll 423 outer surfaces of the overhanging parts of the strip 416 are engaged by an angled roller 480 that is rotatably mounted next to the conveyor 418. Contact with the roller 480 folds the overhanging portions of the strip 416, causing those portions to come into contact with the surfaces 18*a*, 18*b*.

Figure 17:
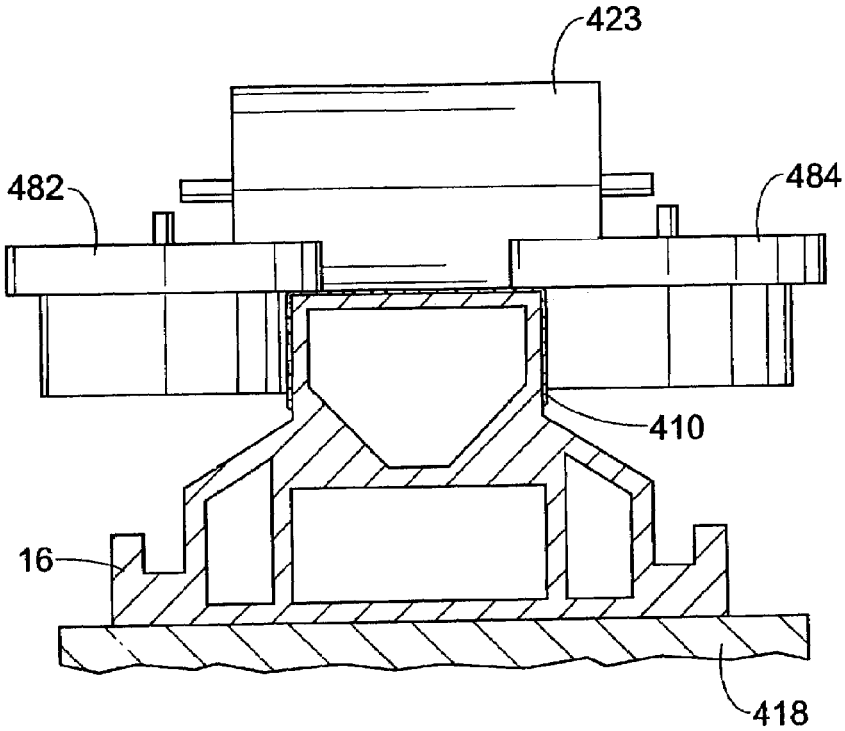
FIG. 17 is a schematic depiction illustrating sash members being fed through a station where an overhanging portion of a laminating covering is heat and pressure treated to adhere to a glass supporting portion of a sash.

Downstream from the angled roller 480, the sash member 16' passes through two side heated pressure rolls 482, 484 (FIGS. 17 and 18). These rolls 482, 484 have stepped outer surfaces. A larger diameter part of each roll overlies the innermost surface 23 and a second reduced diameter portion of the roll engages the surfaces 18*a*, 18*b* to apply pressure to the overlapping portion of the strip 416. These two rolls 482, 484 are also heated so that the combination of pressure and heat applied to the strip 416 causes the covering layer 410 of the overhang portion of the strip 416 to separate from the carrier layer and become adhered to the surface 18*a*, 18*b* as they move through the rolls 182, 194.

Figure 22:
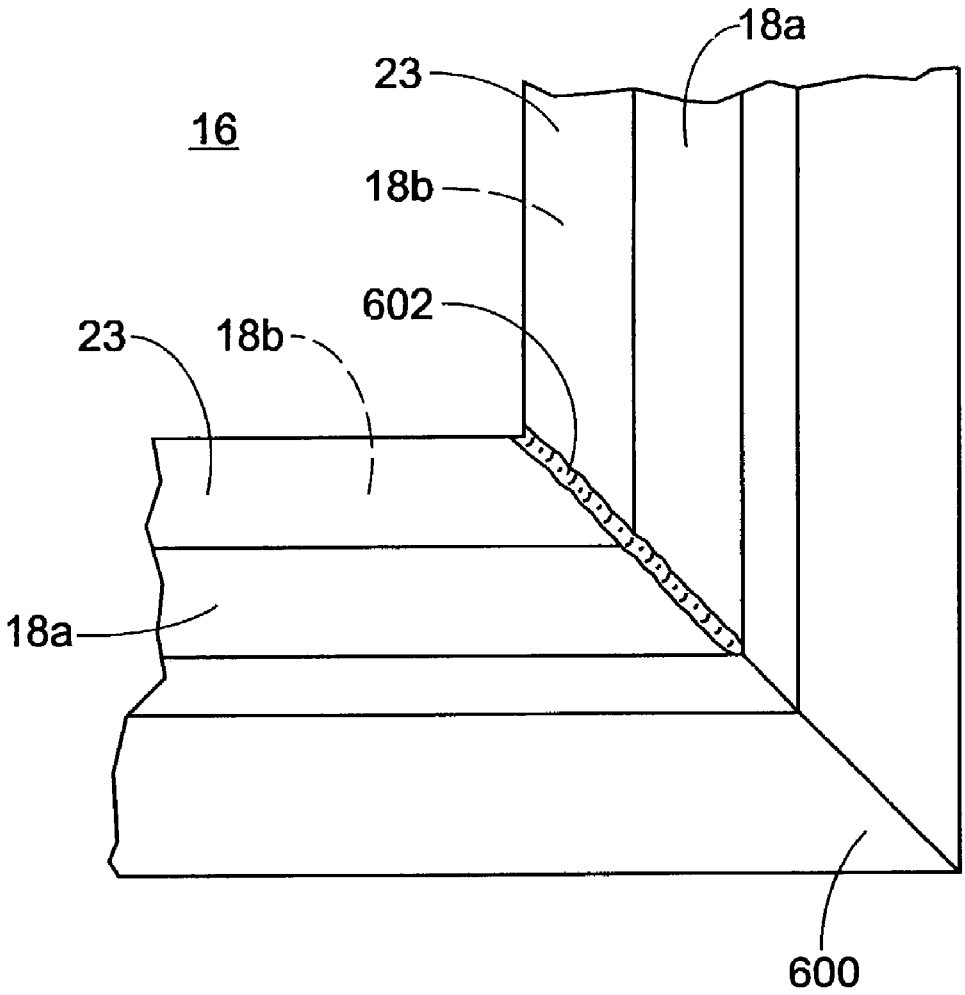
FIG. 22 illustrates a corner of a sash.

In the exemplary embodiment, the elongated sash member 16' are assembled to form a sash 16. The sash members may be assembled by welding ends of the sash members 16' together to define corners 600 of a rectangular sash 16. In an embodiment illustrated by FIG. 22, a bead 602 of sealant 12 is added at each corner 600 of the welded sash to prevent leakage at the corner. The bead 602 covers the intersection of the glass abutting surfaces 18*a*, 18*b* and the innermost surfaces 23 of the sash members 16'. The bead prevents moisture from entering the window unit through the corner 600.

Figure 17A:
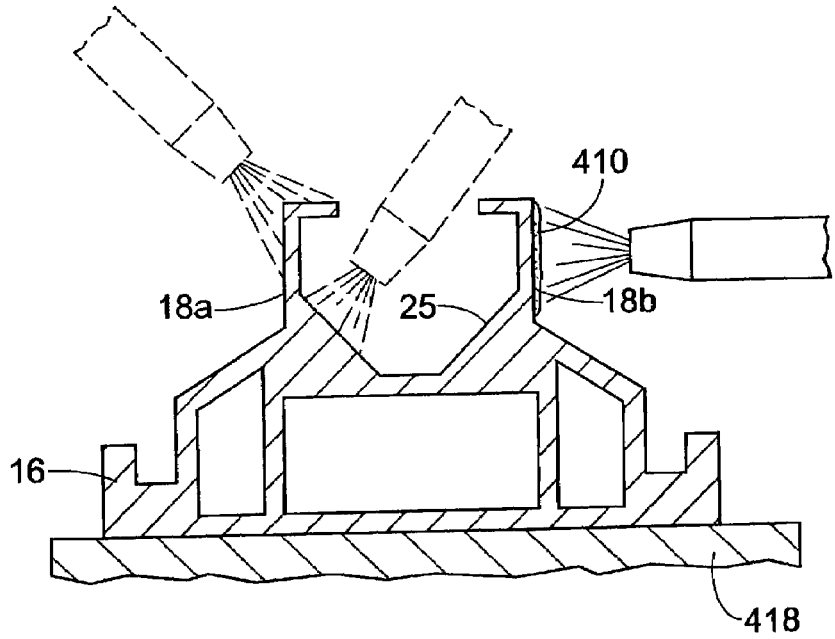
FIG. 17A is a schematic depiction illustrating a vapor barrier material being applied to a sash.

FIG. 17A illustrates an embodiment where the low porosity covering material 410 is a sprayed-on coating. The spray-on coating is illustrated as being used on a sash that defines a concave inner surface. It should be readily apparent that the spray-on coating could also be used on a sash that does not include a concave surface. For example, spray-on coating could be used on the sash shown in FIG. 4A. In the embodiment illustrated by FIG. 17A, the spray-on coating is applied to the outer surfaces 18*a*, 18*b* and the concave inner surface 25. The coating inhibits moisture from entering the unit. The spray-on coating can be applied to elongated sash members 16' before they are assembled into a sash 16 or the spray-on coating can be applied to an assembled sash. In the exemplary embodiment, a bead 602 of sealant is applied to the corners 602 of the sash when the spray-on coating is applied to the elongated sash members before they are assembled. The bead 602 of sealant may not be required if the spray-on coating is applied to an assembled sash 16.

Although the present invention has been described with a degree of particularity, it is the intent that the invention include all modifications and alterations falling within the spirit or scope of the appended claims.

We claim:

1. A method of controlled dispensing of a material onto a window sash, comprising:

a) reading a bar code that indicates a window sash perimeter dimensions to determine a path of travel;

b) relatively moving a material dispensing nozzle with respect to said window sash along said path of travel defined by the perimeter dimensions of the window sash at controlled variable speeds;

c) delivering said material to said nozzle at controlled variable volumetric rates based on the controlled variable speeds of relative motion between the nozzle and the window sash; and d) dispensing the material into contact with a surface of the window sash through said nozzle.

2. A method of controlled dispensing of a material onto a window sash, comprising:

a) relatively moving a material dispensing nozzle with respect to said window sash along a path of travel defined by a perimeter of the window sash at controlled speeds;

b) coupling an inlet of a gear pump to a source of material and an output of said gear pump to the nozzle;

c) pumping said material to said nozzle from the gear pump at controlled volumetric rates based on the controlled relative linear speed of movement between the nozzle and the window sash by controlling an angular velocity of a gear of the gear pump; and c) dispensing the material into contact with a surface of the window sash through said nozzle.

3. The method of claim 2 wherein said nozzle is moved and said window sash is stationary.

4. The method of claim 2 further comprising detecting edges of said sash to determine said path of travel.

5. The method of claim 2 further comprising applying material to first and second sides of said window sash.

6. The method of claim 2 further comprising applying first and second materials to said window sash.

7. The method of claim 6 further comprising blending a portion of said first and second materials as they are dispensed.

8. The method of claim 2 further comprising monitoring a pressure of the material before the material is dispensed from the nozzle.

9. The method of claim 2 further comprising regulating the pressure of the material delivered to the gear pump from the supply based on a pressure sensed before the material is dispensed from the nozzle.

10. The method of claim 2 further comprising adjusting a pressure of the material supplied to the gear pump to minimize a pressure drop between the inlet and the outlet of said gear pump.

11. The method of claim 2 wherein the step of dispensing material into contact with the sash is performed by opening said nozzle and wherein the opening of the nozzle is initiated at a time different than actuation of the gear pump.

12. The method of claim 11 wherein the opening of the nozzle is delayed with respect to actuation of the gear pump.

13. A method of controlled dispensing of a material onto a window sash, comprising:

a) reading a bar code that indicates a window sash perimeter dimensions;

b) determining a path of travel around a window perimeter based on the perimeter dimensions of the sash derived from said bar code;

c) relatively moving a material dispensing nozzle with respect to said window sash along said path of travel defined by perimeter dimensions of the window sash at controlled speeds;

d) delivering said material to said window sash at controlled volumetric rates based on the controlled speeds of relative motion between the nozzle and the window sash; and e) dispensing the material into contact with a surface of the window sash through said nozzle.

14. A method of controlled dispensing of a material onto a window frame, comprising:

a) relatively moving a material dispensing nozzle with respect to said window frame along a path of travel defined by a perimeter of the window frame at controlled variable speeds;

b) delivering controlled amounts of said material through a gear pump coupled to said nozzle at controlled variable volumetric rates by controlling an angular velocity of a gear of the gear pump based on the controlled variable speeds of relative motion between the nozzle and the window frame to deliver a substantially constant volume per unit length of material alone the path of travel; and c) dispensing the material into contact with a surface of the window frame through said nozzle.

* * * * *